US009546534B2

(12) United States Patent
Lecerf et al.

(10) Patent No.: US 9,546,534 B2
(45) Date of Patent: Jan. 17, 2017

(54) TECHNIQUE AND APPARATUS TO FORM A DOWNHOLE FLUID BARRIER

(71) Applicant: Schlumberger Technology Corporation, Sugar Land, TX (US)

(72) Inventors: Bruno Lecerf, Novosibirsk (RU); Dmitry Potapenko, Novosibirsk (RU); Elena Tarasova, Solnechnyj (RU); Robert A. Parrott, Berdsk (RU); Michael Bertoja, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 308 days.

(21) Appl. No.: 13/968,083

(22) Filed: Aug. 15, 2013

(65) Prior Publication Data

US 2015/0047838 A1 Feb. 19, 2015

(51) Int. Cl.
*E21B 33/12* (2006.01)
*E21B 33/134* (2006.01)

(52) U.S. Cl.
CPC ..... *E21B 33/134* (2013.01)

(58) Field of Classification Search
CPC ..... E21B 33/12
See application file for complete search history.

(56) References Cited

U.S. PATENT DOCUMENTS 5,518,996 A 5/1996 Maroy et al.
5,544,705 A * 8/1996 Jones et al. ..... 166/250.04
5,623,993 A * 4/1997 Van Buskirk et al. ..... 166/292
5,905,468 A 5/1999 Ikawa et al.
6,394,184 B2 * 5/2002 Tolman et al. ..... 166/281
6,520,255 B2 * 2/2003 Tolman et al. ..... 166/281
6,543,538 B2 * 4/2003 Tolman et al. ..... 166/284
6,626,991 B1 9/2003 Drochon et al.
6,814,144 B2 * 11/2004 Jones ..... 166/281
7,059,407 B2 * 6/2006 Tolman et al. ..... 166/281
7,278,486 B2 * 10/2007 Alba et al. ..... 166/308.1
7,402,204 B2 7/2008 Le Roy-Delage et al.
7,470,322 B2 12/2008 Drochon et al.
7,527,095 B2 * 5/2009 Bloess et al. ..... 166/265
7,690,427 B2 4/2010 Rispler
7,775,279 B2 8/2010 Marya et al.
(Continued)

FOREIGN PATENT DOCUMENTS

EP 1152996 12/2003
WO WO2011050046 4/2011
(Continued)

OTHER PUBLICATIONS

McDaniel, B.W., "Review of Current Fracture Stimulation Techniques for Best Economics in Multilayer, Lower-Permeability Reservoirs", SPE 98025, SPE Eastern Regional Meeting, Morgantown, WV, U.S.A., Sep. 14-16, 2005, 19 pages.
(Continued)

*Primary Examiner* — Zakiya W Bates
*Assistant Examiner* — Crystal J Miller
(74) *Attorney, Agent, or Firm* — Andrea E. Tran; Tim Curington

(57) ABSTRACT

A technique that is usable with a well includes communicating a stabilized treatment slurry downhole into the well and dehydrating a portion of the slurry to form a barrier in the well.

15 Claims, 9 Drawing Sheets

(56) References Cited

U.S. PATENT DOCUMENTS

| | | | | |
|---|---|---|---|---|
| 7,784,541 | B2 | 8/2010 | Hartman et al. | |
| 7,789,146 | B2 | 9/2010 | Panga et al. | |
| 7,833,947 | B1 | 11/2010 | Kubala | |
| 8,008,234 | B2 | 8/2011 | Panga et al. | |
| 8,119,574 | B2 | 2/2012 | Panga et al. | |
| 8,210,249 | B2 | 7/2012 | Panga et al. | |
| 8,211,247 | B2 | 7/2012 | Marya et al. | |
| 8,227,026 | B2 | 7/2012 | McDaniel et al. | |
| 8,234,072 | B2 | 7/2012 | Smith, Jr. et al. | |
| 8,490,698 | B2 * | 7/2013 | Panga et al. | 166/278 |
| 8,490,699 | B2 * | 7/2013 | Panga et al. | 166/278 |
| 8,505,628 | B2 * | 8/2013 | Panga et al. | 166/278 |
| 8,511,381 | B2 * | 8/2013 | Panga et al. | 166/278 |
| 8,584,753 | B2 * | 11/2013 | Fitzpatrick et al. | 166/278 |
| 8,607,870 | B2 * | 12/2013 | Gu et al. | 166/308.1 |
| 8,887,803 | B2 * | 11/2014 | East et al. | 166/250.01 |
| 2002/0007949 | A1 * | 1/2002 | Tolman et al. | 166/280 |
| 2004/0094299 | A1 * | 5/2004 | Jones | 166/285 |
| 2005/0178551 | A1 * | 8/2005 | Tolman et al. | 166/297 |
| 2006/0124304 | A1 * | 6/2006 | Bloess et al. | 166/285 |
| 2006/0175059 | A1 * | 8/2006 | Sinclair et al. | 166/283 |
| 2007/0029086 | A1 * | 2/2007 | East, Jr. | 166/278 |
| 2008/0105437 | A1 * | 5/2008 | Hill | E21B 43/086 166/370 |
| 2009/0025932 | A1 * | 1/2009 | Panga et al. | 166/278 |
| 2009/0025934 | A1 | 1/2009 | Hartman et al. | |
| 2009/0095463 | A1 * | 4/2009 | Swan | E21B 21/103 166/53 |
| 2009/0114392 | A1 * | 5/2009 | Tolman et al. | 166/305.1 |
| 2010/0300688 | A1 | 12/2010 | Panga et al. | |
| 2011/0155371 | A1 * | 6/2011 | Panga | C09K 8/80 166/278 |
| 2011/0155372 | A1 * | 6/2011 | Panga et al. | 166/278 |
| 2012/0000641 | A1 | 1/2012 | Panga et al. | |
| 2012/0073812 | A1 * | 3/2012 | Cochran | E21B 33/1208 166/283 |
| 2012/0132421 | A1 * | 5/2012 | Loiseau et al. | 166/279 |
| 2012/0138296 | A1 | 6/2012 | Panga et al. | |
| 2013/0264054 | A1 * | 10/2013 | East | E21B 34/14 166/270.1 |
| 2014/0131045 | A1 * | 5/2014 | Loiseau | E21B 43/119 166/305.1 |
| 2014/0151043 | A1 * | 6/2014 | Miller et al. | 166/285 |
| 2014/0251609 | A1 * | 9/2014 | Broussard et al. | 166/278 |
| 2015/0315886 | A1 * | 11/2015 | Potapenko | C09K 8/516 166/305.1 |

FOREIGN PATENT DOCUMENTS

| | | |
|---|---|---|
| WO | WO2012054456 | 4/2012 |
| WO | WO2013085412 | 6/2013 |

OTHER PUBLICATIONS

Wei et al., "Determining the Best Diversion Methods for Tight Gas Sand Stimulation", SPE 126708, 2010 SPE International Symposium and Exhibition on Formation Damage Control, Lafayette, LA, U.S.A., Feb. 10-12, 2010, pp. 13 pages.

U.S. Appl. No. 13/415,025, filed Mar. 8, 2012. Not yet published.

* cited by examiner

TECHNIQUE AND APPARATUS TO FORM A DOWNHOLE FLUID BARRIER

BACKGROUND

For purposes of preparing a well for the production of oil or gas, at least one perforating gun may be deployed into the well via a conveyance mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing.

When hydrocarbon resources include multiple reservoir intervals, which are either discretely disposed or contained in relatively long production intervals, accessing the reserves may involve fracturing the well at various depths. Thus, the above-described perforating and stimulation operations may be performed in multiple stages of the well.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, a technique that is usable with a well includes communicating a stabilized treatment slurry downhole into the well and dehydrating a portion of the slurry to form a fluid barrier in the well.

In another example implementation, a technique that is usable with a well includes communicating a stabilized treatment slurry downhole into a stage of the well. The communication includes using a tool to engage the slurry and pumping the tool and the slurry together downhole into the well. The tool includes a screen and a chamber that, when closed, has a lower pressure than a region outside of the chamber. The technique includes opening the chamber to cause a continuous fluid phase to separate from the slurry and flow through the screen into the chamber to create a plug in the stage.

In yet another example implementation, an apparatus that is usable with a well includes a chamber, a screen and a flow control element. The chamber has an initial pressure, which is less than a pressure in a region outside of the chamber. The flow control element allows a fluid to be communicated from a stabilized treatment slurry, through the screen and into the chamber to controllably dehydrate a portion of the slurry to create a fluid barrier in the well.

Advantages and other features will become apparent from the following drawings, description and claims.

DETAILED DESCRIPTION

In general, systems and techniques are disclosed herein to controllably dehydrate a stabilized treatment slurry (STS) to form a fluid obstruction, or fluid barrier, at a desired downhole location in a well. In this regard, the fluid barrier may be used to form a boundary of an isolated zone, or stage, in the well for purposes of performing a stimulation operation in the stage, such as a fracturing operation or an acidizing operation. Moreover, systems and techniques that are disclosed herein to form multiple fluid barriers in multiple stages of a multistage completion.

In accordance with example implementations, the fluid barrier is a "pump down plug," which is formed by pumping a slurry to a target location of the well and then dehydrating part of the slurry to form a fluid barrier, or plug, at the target location. More specifically, in accordance with example implementations, an STS layer is pumped downhole and a tool is pumped immediately downhole behind the STS layer. The tool serves as a piston to move the STS layer to the target position. When the tool reaches the target position, the tool is activated, which opens a lower pressure chamber of the tool so that the chamber receives a continuous fluid phase from the STS layer. The separation of the continuous fluid phase from the STS layer rapidly dehydrates a portion of the STS layer in a controlled manner to create a portion of the STS layer, which contains solids, thereby creating the plug.

Figure 1:
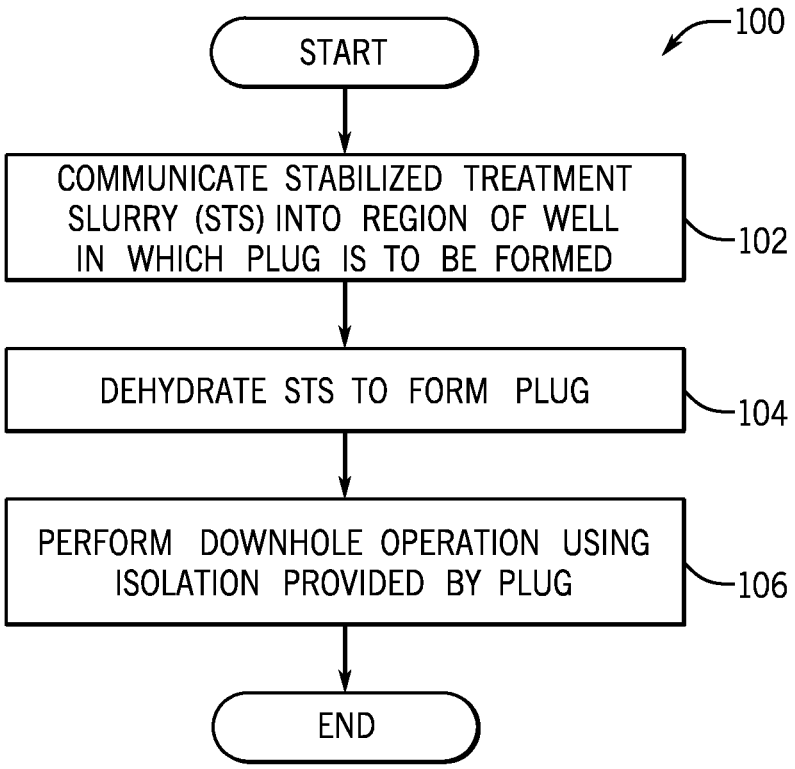
FIG. 1 is a flow diagram depicting a technique to form a fluid barrier in a well according to an example implementation.

Thus, referring to FIG. 1, a technique 100 in accordance with example implementations includes communicating (block 102) a stabilized treatment slurry (STS) into a region of a well in which a fluid barrier, or plug, is to be formed. The STS slurry is dehydrated, pursuant to block 104, to form the plug so that a downhole operation may be performed (block 106) using the isolation that is provided by the plug.

As used herein, "slurry" refers to a mixture of particles, which are dispersed in a fluid carrier. and the mixture may be flowable. The terms "flowable," "pumpable," and "mixable" are used interchangeably herein and refer to a fluid or slurry that has either a yield stress or low-shear (5.11 $s^{-1}$) viscosity less than 1000 Pascals (Pa) and a dynamic apparent viscosity of less than 10 Pa-s (10,000 cP) at a shear rate 170 $s^{-1}$, where yield stress, low-shear viscosity and dynamic apparent viscosity are measured at a temperature of 25° C., unless another temperature is specified explicitly or is apparent from the context of use.

"Viscosity" as used herein, unless otherwise indicated, refers to the apparent dynamic viscosity of a fluid at a temperature of 25° C. and shear rate of 170 $s^{-1}$. "Low-shear viscosity" as used herein unless otherwise indicated refers to the apparent dynamic viscosity of a fluid at a temperature of 25° C. and shear rate of 5.11 $s^{-1}$. Yield stress and viscosity of the treatment fluid are evaluated at 25° C. in a Fann 35 rheometer with an R1B5F1 spindle, or an equivalent rheometer/spindle arrangement, with shear rate ramped up to 255 $s^{-1}$ (300 rpm) and back down to 0, an average of the two readings at 2.55, 5.11, 85.0, 170 and 255 $s^{-1}$ (3, 6, 100, 200 and 300 rpm) recorded as the respective shear stress, the apparent dynamic viscosity is determined as the ratio of shear stress to shear rate ($\tau/\gamma$) at $\gamma$=170 $s^{-1}$, and the yield stress ($\tau_0$) (if any) is determined as the y-intercept using a best fit of the Herschel-Buckley rheological model, $\tau=\tau_0+k(\gamma)^n$, where $\tau$ is the shear stress, k is a constant, $\gamma$ is the shear rate and n is the power law exponent. Where the power law exponent is equal to 1, the Herschel-Buckley fluid is also referred to as a Bingham plastic. Yield stress as used herein is synonymous with yield point and refers to the stress required to initiate flow in a Bingham plastic or Herschel-Buckley fluid system calculated as the y-intercept in the manner described herein. A "yield stress fluid" refers to a Herschel-Buckley fluid system, including Bingham plastics or another fluid system in which an applied non-zero stress as calculated in the manner described herein is required to initiate fluid flow.

The following conventions with respect to slurry terms are intended herein unless otherwise indicated explicitly or implicitly by context.

"Treatment fluid" or "fluid" (in context) refers to the entire treatment fluid, including any proppant, subproppant particles, liquid, gas etc. "Whole fluid," "total fluid" and "base fluid" are used herein to refer to the fluid phase plus any subproppant particles dispersed therein, but exclusive of proppant particles. "Carrier," "fluid phase" or "liquid phase" refer to the fluid or liquid that is present, which may comprise a continuous phase and optionally one or more discontinuous fluid phases dispersed in the continuous phase, including any solutes, thickeners or colloidal particles only, exclusive of other solid phase particles; reference to "water" in the slurry refers only to water and excludes any particles, solutes, thickeners, colloidal particles, etc.; reference to "aqueous phase" refers to a carrier phase comprised predominantly of water, which may be a continuous or dispersed phase. As used herein the terms "liquid" or "liquid phase" encompasses both liquids per se and supercritical fluids, including any solutes dissolved therein.

The measurement or determination of the viscosity of the liquid phase (as opposed to the treatment fluid or base fluid) may be based on a direct measurement of the solids-free liquid, or a calculation or correlation based on a measurement(s) of the characteristics or properties of the liquid containing the solids, or a measurement of the solids-containing liquid using a technique where the determination of viscosity is not affected by the presence of the solids. As used herein, solids-free for the purposes of determining the viscosity of the liquid phase means in the absence of non-colloidal particles larger than 1 micron such that the particles do not affect the viscosity determination, but in the presence of any submicron or colloidal particles that may be present to thicken and/or form a gel with the liquid, i.e., in the presence of ultrafine particles that may function as a thickening agent. In some example implementations, a "low viscosity liquid phase" means a viscosity less than about 300 mPa-s measured without any solids greater than 1 micron at 170 $s^{-1}$ and 25° C.

In some example implementations, the treatment fluid may include a continuous fluid phase, also referred to as an external phase, and a discontinuous phase(s), also referred to as an internal phase(s), which may be a fluid (liquid or gas) in the case of an emulsion, foam or energized fluid, or which may be a solid in the case of a slurry. The continuous fluid phase may be any matter that is substantially continuous under a given condition. Examples of the continuous fluid phase include, but are not limited to, water, hydrocarbon, gas, liquefied gas, etc., which may include solutes, e.g. the fluid phase may be a brine, and/or may include a brine or other solution(s). In some example implementations, the fluid phase(s) may optionally include a viscosifying and/or yield point agent and/or a portion of the total amount of viscosifying and/or yield point agent present. Some non-limiting examples of the fluid phase(s) include hydratable gels (e.g. gels containing polysaccharides such as guars, xanthan and diutan, hydroxyethylcellulose, polyvinyl alcohol, other hydratable polymers, colloids, etc.), a cross-linked hydratable gel, a viscosified acid (e.g. gel-based), an emulsified acid (e.g. oil outer phase), an energized fluid (e.g., an $N_2$ or $CO_2$ based foam), a viscoelastic surfactant (VES) viscosified fluid, and an oil-based fluid including a gelled, foamed, or otherwise viscosified oil.

The discontinuous phase, if present in the treatment fluid, may be any particles (including fluid droplets) that are suspended or otherwise dispersed in the continuous phase in a disjointed manner. In this respect, the discontinuous phase may also be referred to, collectively, as "particle" or "particulate" which may be used interchangeably. As used herein, the term "particle" should be construed broadly. For example, in some example implementations, the particle(s) of the current application are solid such as proppant, sands, ceramics, crystals, salts, etc.; however, in some other implementations, the particle(s) may be liquid, gas, foam, emulsified droplets, etc. Moreover, in some example implementations, the particle(s) of the current application are substantially stable and do not change shape or form over an extended period of time, temperature, or pressure; in some other implementations, the particle(s) of the current application are degradable, dissolvable, deformable, meltable, sublimeable, or otherwise capable of being changed in shape, state, or structure.

In certain example implementations, the particle(s) is substantially round and spherical. In some certain example implementations, the particle(s) is not substantially spherical and/or round, e.g., it may have varying degrees of sphericity and roundness, according to the API RP-60 sphericity and roundness index. For example, the particle(s) may have an aspect ratio, defined as the ratio of the longest dimension of the particle to the shortest dimension of the particle, of more than 2, 3, 4, 5 or 6. Examples of such non-spherical particles include, but are not limited to, fibers, flakes, discs, rods, stars, etc. All such variations should be considered within the scope of the current application.

The particles in the slurry in various implementations may be multimodal. As used herein multimodal refers to a plurality of particle sizes or modes which each has a distinct size or particle size distribution, e.g., proppant and fines. As used herein, the terms distinct particle sizes, distinct particle size distribution, or multi-modes or multimodal, mean that each of the plurality of particles has a unique volume-averaged particle size distribution (PSD) mode. That is, statistically, the particle size distributions of different particles appear as distinct peaks (or "modes") in a continuous probability distribution function. For example, a mixture of two particles having normal distribution of particle sizes with similar variability is considered a bimodal particle mixture if their respective means differ by more than the sum of their respective standard deviations, and/or if their respective means differ by a statistically significant amount. In certain example implementations, the particles contain a bimodal mixture of two particles; in certain other implementations, the particles contain a trimodal mixture of three particles; in certain additional implementations, the particles contain a tetramodal mixture of four particles; in certain further implementations, the particles contain a pentamodal mixture of five particles, and so on. Representative references disclosing multimodal particle mixtures include U.S. Pat. No. 5,518,996, U.S. Pat. No. 7,784,541, U.S. Pat. No. 7,789,146, U.S. Pat. No. 8,008,234, U.S. Pat. No. 8,119,574, U.S. Pat. No. 8,210,249, U.S. Patent Application Publication No. US 2010/0300688, U.S. Patent Application Publication No. US 2012/0000641, U.S. Patent Application Publication No. US 2012/0138296, U.S. Patent No. 2012/0132421, U.S. Patent Application No. 2012/0111563, PCT Application Publication No. WO 2012/054456, U.S. Patent Application Publication No. US 2012/0305245, U.S. Patent Application Publication No. US 2012/0305254, U.S. Patent Application Publication No. US 2012/0132421, PCT Application Publication No. WO2013/0085412 and U.S. patent Ser. No. 13/415,025, each of which is hereby incorporated by reference in its entirety.

"Solids" and "solids volume" refer to all solids present in the slurry, including proppant and subproppant particles, including particulate thickeners such as colloids and submicron particles. "Solids-free" and similar terms generally exclude proppant and subproppant particles, except particulate thickeners such as colloids for the purposes of determining the viscosity of a "solids-free" fluid. "Proppant" refers to particulates that are used in well work-overs and treatments, such as hydraulic fracturing operations, to hold fractures open following the treatment, of a particle size mode or modes in the slurry having a weight average mean particle size greater than or equal to about 100 microns, e.g., 140 mesh particles correspond to a size of 105 microns, unless a different proppant size is indicated in the claim or a smaller proppant size is indicated in a claim depending therefrom. "Gravel" refers to particles used in gravel packing, and the term is synonymous with proppant as used herein. "Sub-proppant" or "subproppant" refers to particles or particle size or mode (including colloidal and submicron particles) having a smaller size than the proppant mode(s); references to "proppant" exclude subproppant particles and vice versa. In some example implementations, the subproppant mode or modes each have a weight average mean particle size less than or equal to about one-half of the weight average mean particle size of a smallest one of the proppant modes, e.g., a suspensive/stabilizing mode.

The proppant, when present, may be naturally occurring materials, such as sand grains. The proppant, when present, may also be man-made or specially engineered, such as coated (including resin-coated) sand, modulus of various nuts, high-strength ceramic materials like sintered bauxite, etc. In some example implementations, the proppant of the current application, when present, has a density greater than 2.45 g/mL, e.g., 2.5-2.8 g/mL, such as sand, ceramic, sintered bauxite or resin coated proppant. In some example implementations, the proppant of the current application, when present, has a density less than or equal to 2.45 g/mL, such as less than about 1.60 g/mL, less than about 1.50 g/mL, less than about 1.40 g/mL, less than about 1.30 g/mL, less than about 1.20 g/mL, less than 1.10 g/mL, or less than 1.00 g/mL, such as light/ultralight proppant from various manufacturers, e.g., hollow proppant.

In some example implementations, the treatment fluid includes an apparent specific gravity greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3. The treatment fluid density may be selected by selecting the specific gravity and amount of the dispersed solids and/or adding a weighting solute to the aqueous phase, such as, for example, a compatible organic or mineral salt. In some example implementations, the aqueous or other liquid phase may have a specific gravity greater than 1, greater than 1.05, greater than 1.1, greater than 1.2, greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3, etc. In some example implementations, the aqueous or other liquid phase may have a specific gravity less than 1. In example implementations, the weight of the treatment fluid may provide additional hydrostatic head pressurization in the wellbore at the perforations or other fracture location, and may also facilitate stability by lessening the density differences between the larger solids and the whole remaining fluid. In other implementations, a low density proppant may be used in the treatment, for example, lightweight proppant (apparent specific gravity less than 2.65) having a density less than or equal to 2.5 g/mL, such as less than about 2 g/mL, less than about 1.8 g/mL, less than about 1.6 g/mL, less than about 1.4 g/mL, less than about 1.2 g/mL, less than 1.1 g/mL, or less than 1 g/mL. In other implementations, the proppant or other particles in the slurry may have a specific gravity greater than 2.6, greater than 2.7, greater than 2.8, greater than 2.9, greater than 3, etc.

"Stable" or "stabilized" or similar terms refer to a stabilized treatment slurry (STS) wherein gravitational settling of the particles is inhibited such that no or minimal free liquid is formed, and/or there is no or minimal rheological variation among strata at different depths in the STS, and/or the slurry may generally be regarded as stable over the duration of expected STS storage and use conditions, e.g., an STS that passes a stability test or an equivalent thereof. In certain example implementations, stability may be evaluated following different settling conditions, such as for example static under gravity alone, or dynamic under a vibratory influence, or dynamic-static conditions employing at least one dynamic settling condition followed and/or preceded by at least one static settling condition.

The static settling test conditions may include gravity settling for a specified period, e.g., 24 hours, 48 hours, 72 hours, or the like, which are generally referred to with the respective shorthand notation "24 h-static", "48 h-static" or "72 h static". Dynamic settling test conditions generally indicate the vibratory frequency and duration, e.g., 4 h@15 Hz (4 hours at 15 Hz), 8 h@5 Hz (8 hours at 5 Hz), or the like. Dynamic settling test conditions are at a vibratory amplitude of 1 mm vertical displacement unless otherwise indicated. Dynamic-static settling test conditions will indicate the settling history preceding analysis including the total duration of vibration and the final period of static conditions, e.g., 4 h@15 Hz/20 h-static refers to 4 hours vibration followed by 20 hours static, or 8 h@15 Hz/10 d-static refers to 8 hours total vibration, e.g., 4 hours vibration followed by 20 hours static followed by 4 hours vibration, followed by 10 days of static conditions. In the absence of a contrary indication, the designation "8 h@15 Hz/10 d-static" refers to the test conditions of 4 hours vibration, followed by 20 hours static followed by 4 hours vibration, followed by 10 days of static conditions. In the absence of specified settling conditions, the settling condition is 72 hours static. The stability settling and test conditions are at 25° C. unless otherwise specified.

In certain example implementations, one stability test is referred to herein as the "8 h@15 Hz/10 d-static STS stability test", wherein a slurry sample is evaluated in a rheometer at the beginning of the test and compared against different strata of a slurry sample placed and sealed in a 152 mm (6 in.) diameter vertical gravitational settling column filled to a depth of 2.13 m (7 ft), vibrated at 15 Hz with a 1 mm amplitude (vertical displacement) two 4-hour periods the first and second settling days, and thereafter maintained in a static condition for 10 days (12 days total settling time). The 15 Hz/1 mm amplitude condition in this test is selected to correspond to surface transportation and/or storage conditions prior to the well treatment. At the end of the settling period the depth of any free water at the top of the column is measured, and samples obtained, in order from the top sampling port down to the bottom, through 25.4-mm sampling ports located on the settling column at 190 mm (6'3"), 140 mm (4'7"), 84 mm (2'9") and 33 mm (1'1"), and rheologically evaluated for viscosity and yield stress as described above.

As used herein, a stabilized treatment slurry (STS) may meet at least one of the following conditions:

(1) the slurry has a low-shear viscosity equal to or greater than 1 Pa-s (5.11 $s^{-1}$, 25° C.);

(2) the slurry has a Herschel-Buckley (including Bingham plastic) yield stress (as determined in the manner described herein) equal to or greater than 1 Pa; or (3) the largest particle mode in the slurry has a static settling rate less than 0.01 mm/hr; or (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or (6) the slurry solids volume fraction (SVF) across the column strata below any free water layer after the 72-hour static settling test condition or the 8 h@15 Hz/10 d-static dynamic settling test condition is no more than 5% greater than the initial SVF; or (7) the density across the column strata below any free water layer after the 72-hour static settling test condition or the 8 h@15 Hz/10 d-static dynamic settling test condition is no more than 1% of the initial density.

In example implementations, the depth of any free fluid at the end of the 8 h@15 Hz/10 d-static dynamic settling test condition is no more than 2% of total depth, the apparent dynamic viscosity (25° C., 170 s-1) across column strata after the 8 h@15 Hz/10 d-static dynamic settling test condition is no more than +/−20% of the initial dynamic viscosity, the slurry solids volume fraction (SVF) across the column strata below any free water layer after the 8 h@15 Hz/10 d-static dynamic settling test condition is no more than 5% greater than the initial SVF, and the density across the column strata below any free water layer after the 8 h@15 Hz/10 d-static dynamic settling test condition is no more than 1% of the initial density.

In some example implementations, the treatment slurry includes at least one of the following stability indicia: (1) an SVF of at least 0.4 up to SVF=PVF; (2) a low-shear viscosity of at least 1 Pa-s (5.11 $s^{-1}$, 25° C.); (3) a yield stress (as determined herein) of at least 1 Pa; (4) an apparent viscosity of at least 50 mPa-s (170 $s^{-1}$, 25° C.); (5) a multimodal solids phase; (6) a solids phase having a PVF greater than 0.7; (7) a viscosifier selected from viscoelastic surfactants, in an amount ranging from 0.01 up to 7.2 g/L (60 ppt), and hydratable gelling agents in an amount ranging from 0.01 up to 4.8 g/L (40 ppt) based on the volume of fluid phase; (8) colloidal particles; (9) a particle-fluid density delta less than 1.6 g/mL, (e.g., particles having a specific gravity less than 2.65 g/mL, carrier fluid having a density greater than 1.05 g/mL or a combination thereof); (10) particles having an aspect ratio of at least 6; (11) ciliated or coated proppant; and (12) combinations thereof.

In some example implementations, the stabilized slurry includes at least two of the stability indicia, such as for example, the SVF of at least 0.4 and the low-shear viscosity of at least 1 Pa-s (5.11 $s^{-1}$, 25° C.); and optionally one or more of the yield stress of at least 1 Pa, the apparent viscosity of at least 50 mPa-s (170 $s^{-1}$, 25° C.), the multimodal solids phase, the solids phase having a PVF greater than 0.7, the viscosifier, the colloidal particles, the particle-fluid density delta less than 1.6 g/mL, the particles having an aspect ratio of at least 6, the ciliated or coated proppant, or a combination thereof.

In some example implementations, the stabilized slurry includes at least three of the stability indicia, such as for example, the SVF of at least 0.4, the low-shear viscosity of at least 1 Pa-s (5.11 $s^{-1}$, 25° C.) and the yield stress of at least 1 Pa; and optionally one or more of the apparent viscosity of at least 50 mPa-s (170 $s^{-1}$, 25° C.), the multimodal solids phase, the solids phase having a PVF greater than 0.7, the viscosifier, the colloidal particles, the particle-fluid density delta less than 1.6 g/mL, the particles having an aspect ratio of at least 6, the ciliated or coated proppant, or a combination thereof.

In some example implementations, the stabilized slurry includes at least four of the stability indicia, such as for example, the SVF of at least 0.4, the low-shear viscosity of at least 1 Pa-s (5.11 $s^{-1}$, 25° C.), the yield stress of at least 1 Pa and the apparent viscosity of at least 50 mPa-s (170 $s^{-1}$, 25° C.); and optionally one or more of the multimodal solids phase, the solids phase having a PVF greater than 0.7, the viscosifier, colloidal particles, the particle-fluid density delta less than 1.6 g/mL, the particles having an aspect ratio of at least 6, the ciliated or coated proppant, or a combination thereof.

In some example implementations, the stabilized slurry includes at least five of the stability indicia, such as for example, the SVF of at least 0.4, the low-shear viscosity of at least 1 Pa-s (5.11 $s^{-1}$, 25° C.), the yield stress of at least 1 Pa, the apparent viscosity of at least 50 mPa-s (170 $s^{-1}$, 25° C.) and the multimodal solids phase, and optionally one or more of the solids phase having a PVF greater than 0.7, the viscosifier, colloidal particles, the particle-fluid density delta less than 1.6 g/mL, the particles having an aspect ratio of at least 6, the ciliated or coated proppant, or a combination thereof.

In some example implementations, the stabilized slurry includes at least six of the stability indicia, such as for example, the SVF of at least 0.4, the low-shear viscosity of at least 1 Pa-s (5.11 $s^{-1}$, 25° C.), the yield stress of at least 1 Pa, the apparent viscosity of at least 50 mPa-s (170 $s^{-1}$, 25° C.), the multimodal solids phase and one or more of the solids phase having a PVF greater than 0.7, and optionally the viscosifier, colloidal particles, the particle-fluid density delta less than 1.6 g/mL, the particles having an aspect ratio of at least 6, the ciliated or coated proppant, or a combination thereof.

In example implementations, the treatment slurry is formed (stabilized) by at least one of the following slurry stabilization operations: (1) introducing sufficient particles into the slurry or treatment fluid to increase the SVF of the treatment fluid to at least 0.4; (2) increasing a low-shear viscosity of the slurry or treatment fluid to at least 1 Pa-s (5.11 $s^{-1}$, 25° C.); (3) increasing a yield stress of the slurry or treatment fluid to at least 1 Pa; (4) increasing apparent viscosity of the slurry or treatment fluid to at least 50 mPa-s (170 $s^{-1}$, 25° C.); (5) introducing a multimodal solids phase into the slurry or treatment fluid; (6) introducing a solids phase having a PVF greater than 0.7 into the slurry or treatment fluid; (7) introducing into the slurry or treatment fluid a viscosifier selected from viscoelastic surfactants, e.g., in an amount ranging from 0.01 up to 7.2 g/L (60 ppt), and hydratable gelling agents, e.g., in an amount ranging from 0.01 up to 4.8 g/L (40 ppt) based on the volume of fluid phase; (8) introducing colloidal particles into the slurry or treatment fluid; (9) reducing a particle-fluid density delta to less than 1.6 g/mL (e.g., introducing particles having a specific gravity less than 2.65 g/mL, carrier fluid having a density greater than 1.05 g/mL or a combination thereof); (10) introducing particles into the slurry or treatment fluid having an aspect ratio of at least 6; (11) introducing ciliated or coated proppant into slurry or treatment fluid; and (12) combinations thereof. The slurry stabilization operations may be separate or concurrent, e.g., introducing a single viscosifier may also increase low-shear viscosity, yield stress, apparent viscosity, etc., or alternatively or additionally with respect to a viscosifier, separate agents may be added to increase low-shear viscosity, yield stress and/or apparent viscosity.

The techniques to stabilize particle settling in various implementations herein may use any one, or a combination of any two or three, or all of these approaches, i.e., a manipulation of particle/fluid density, carrier fluid viscosity, solids fraction, yield stress, and/or may use another approach. In example implementations, the stabilized slurry is formed by at least two of the slurry stabilization operations, such as, for example, increasing the SVF and increasing the low-shear viscosity of the treatment fluid, and optionally one or more of increasing the yield stress, increasing the apparent viscosity, introducing the multimodal solids phase, introducing the solids phase having the PVF greater than 0.7, introducing the viscosifier, introducing the colloidal particles, reducing the particle-fluid density delta, introducing the particles having the aspect ratio of at least 6, introducing the ciliated or coated proppant or a combination thereof.

In example implementations, the stabilized slurry is formed by at least three of the slurry stabilization operations, such as, for example, increasing the SVF, increasing the low-shear viscosity and introducing the multimodal solids phase, and optionally one or more of increasing the yield stress, increasing the apparent viscosity, introducing the solids phase having the PVF greater than 0.7, introducing the viscosifier, introducing the colloidal particles, reducing the particle-fluid density delta, introducing the particles having the aspect ratio of at least 6, introducing the ciliated or coated proppant or a combination thereof.

In example implementations, the stabilized slurry is formed by at least four of the slurry stabilization operations, such as, for example, increasing the SVF, increasing the low-shear viscosity, increasing the yield stress and increasing apparent viscosity, and optionally one or more of introducing the multimodal solids phase, introducing the solids phase having the PVF greater than 0.7, introducing the viscosifier, introducing colloidal particles, reducing the particle-fluid density delta, introducing particles into the treatment fluid having the aspect ratio of at least 6, introducing the ciliated or coated proppant or a combination thereof.

In example implementations, the stabilized slurry is formed by at least five of the slurry stabilization operations, such as, for example, increasing the SVF, increasing the low-shear viscosity, increasing the yield stress, increasing the apparent viscosity and introducing the multimodal solids phase, and optionally one or more of introducing the solids phase having the PVF greater than 0.7, introducing the viscosifier, introducing colloidal particles, reducing the particle-fluid density delta, introducing particles into the treatment fluid having the aspect ratio of at least 6, introducing the ciliated or coated proppant or a combination thereof.

Decreasing the density difference between the particle and the carrier fluid may be done in example implementations by employing porous particles, including particles with an internal porosity, i.e., hollow particles. However, the porosity may also have a direct influence on the mechanical properties of the particle, e.g., the elastic modulus, which may also decrease significantly with an increase in porosity. In certain example implementations employing particle porosity, care should be taken so that the crush strength of the particles exceeds the maximum expected stress for the particle, e.g., in the implementations of proppants placed in a fracture the overburden stress of the subterranean formation in which it is to be used should not exceed the crush strength of the proppants.

In example implementations, yield stress fluids, and also fluids having a high low-shear viscosity, are used to retard the motion of the carrier fluid and thus retard particle settling. The gravitational stress exerted by the particle at rest on the fluid beneath it must generally exceed the yield stress of the fluid to initiate fluid flow and thus settling onset. For a single particle of density 2.7 g/mL and diameter of 600 μm settling in a yield stress fluid phase of 1 g/mL, the critical fluid yield stress, i.e., the minimum yield stress to prevent settling onset, in this example is 1 Pa. The critical fluid yield stress might be higher for larger particles, including particles with size enhancement due to particle clustering, aggregation or the like.

Increasing carrier fluid viscosity in a Newtonian fluid also proportionally increases the resistance of the carrier fluid motion. In some example implementations, the fluid carrier has a lower limit of apparent dynamic viscosity, determined at 170 $s^{-1}$ and 25° C., of at least about 0.1 mPa-s, or at least about 1 mPa-s, or at least about 10 mPa-s, or at least about 25 mPa-s, or at least about 50 mPa-s, or at least about 75 mPa-s, or at least about 100 mPa-s, or at least about 150 mPa-s. A disadvantage of increasing the viscosity is that as the viscosity increases, the friction pressure for pumping the slurry generally increases as well. In some example implementations, the fluid carrier has an upper limit of apparent dynamic viscosity, determined at 170 $s^{-1}$ and 25° C., of less than about 300 mPa-s, or less than about 150 mPa-s, or less than about 100 mPa-s, or less than about 75 mPa-s, or less than about 50 mPa-s, or less than about 25 mPa-s, or less than about 10 mPa-s. In example implementations, the fluid phase viscosity ranges from any lower limit to any higher upper limit.

In some example implementations, an agent may both viscosify and impart yield stress characteristics, and in further implementations may also function as a friction reducer to reduce friction pressure losses in pumping the treatment fluid. In example implementations, the liquid phase is essentially free of viscosifier or comprises a viscosifier in an amount ranging from 0.01 up to 2.4 g/L (0.08-20 lb/1000 gals) of the fluid phase. The viscosifier may be a viscoelastic surfactant (VES) or a hydratable gelling agent such as a polysaccharide, which may be crosslinked. When using viscosifiers and/or yield stress fluids, it may be useful to consider the need for and if necessary implement a clean-up procedure, i.e., removal or inactivation of the viscosifier and/or yield stress fluid during or following the treatment procedure, since fluids with viscosifiers and/or yield stresses may present clean up difficulties in some situations or if not used correctly. In certain example implementations, clean up may be effected using a breaker(s). In some example implementations, the slurry is stabilized for storage and/or pumping or other use at the surface conditions, and clean-up is achieved downhole at a later time and at a higher temperature, e.g., for some formations, the temperature difference between surface and downhole may be significant and useful for triggering degradation of the viscosifier, the particles, a yield stress agent or characteristic, and/or a breaker. Thus In some example implementations, breakers that are either temperature sensitive or time sensitive, either through delayed action breakers or delay in mixing the breaker into the slurry, may be useful.

In certain example implementations, the fluid may be stabilized by introducing colloidal particles into the treatment fluid, such as, for example, colloidal silica, which may function as a gellant and/or thickener.

In addition or as an alternative to increasing the viscosity of the carrier fluid (with or without density manipulation), increasing the volume fraction of the particles in the treatment fluid may also hinder movement of the carrier fluid. Where the particles are not deformable, the particles interfere with the flow of the fluid around the settling particle to cause hindered settling. The addition of a large volume fraction of particles may be complicated, however, by increasing fluid viscosity and pumping pressure, and increasing the risk of loss of fluidity of the slurry in the event of carrier fluid losses. In some example implementations, the treatment fluid has a lower limit of apparent dynamic viscosity, determined at 170 $s^{-1}$ and 25° C., of at least about 1 mPa-s, or at least about 10 mPa-s, or at least about 25 mPa-s, or at least about 50 mPa-s, or at least about 75 mPa-s, or at least about 100 mPa-s, or at least about 150 mPa-s, or at least about 300 mPa-s, and an upper limit of apparent dynamic viscosity, determined at 170 $s^{-1}$ and 25° C., of less than about 500 mPa-s, or less than about 300 mPa-s, or less than about 150 mPa-s, or less than about 100 mPa-s, or less than about 75 mPa-s, or less than about 50 mPa-s, or less than about 25 mPa-s, or less than about 10 mPa-s. In example implementations, the treatment fluid viscosity ranges from any lower limit to any higher upper limit.

In example implementations, the treatment fluid may be stabilized by introducing sufficient particles into the treatment fluid to increase the SVF of the treatment fluid, e.g., to at least 0.5. In a powder or particulated medium, the packed volume fraction (PVF) is defined as the volume of space occupied by the particles (the absolute volume) divided by the bulk volume, i.e., the total volume of the particles plus the void space between them:

$$PVF=\text{Particle volume}/(\text{Particle volume}+\text{Non-particle Volume})=1-\phi$$

For the purposes of calculating PVF and slurry solids volume fraction (SVF) herein, the particle volume includes the volume of any colloidal and/or submicron particles.

Here, the porosity, $\phi$, is the void fraction of the powder pack. Unless otherwise specified the PVF of a particulated medium is determined in the absence of overburden or other compressive force that would deform the packed solids. The packing of particles (in the absence of overburden) is a purely geometrical phenomenon. Therefore, the PVF depends only on the size and the shape of particles. The most ordered arrangement of monodisperse spheres (spheres with exactly the same size in a compact hexagonal packing) has a PVF of 0.74. However, such highly ordered arrangements of particles rarely occur in industrial operations. Rather, a somewhat random packing of particles is prevalent in oilfield treatment. Unless otherwise specified, particle packing in the current application means random packing of the particles. A random packing of the same spheres has a PVF of 0.64. In other words, the randomly packed particles occupy 64% of the bulk volume, and the void space occupies 36% of the bulk volume. A higher PVF may be achieved by preparing blends of particles that have more than one particle size and/or a range(s) of particle sizes. The smaller particles may fit in the void spaces between the larger ones.

The PVF In example implementations may therefore be increased by using a multimodal particle mixture, for example, coarse, medium and fine particles in specific volume ratios, where the fine particles may fit in the void spaces between the medium-size particles, and the medium size particles may fit in the void space between the coarse particles. For some implementations of two consecutive size classes or modes, the ratio between the mean particle diameters ($d_{50}$) of each mode may be between 7 and 10. In such cases, the PVF may increase up to 0.95 in some example implementations. By blending coarse particles (such as proppant) with other particles selected to increase the PVF, only a minimum amount of fluid phase (such as water) is needed to render the treatment fluid pumpable. Such concentrated suspensions (i.e. slurry) tend to behave as a porous solid and may shrink under the force of gravity. This is a hindered settling phenomenon as discussed above and, as mentioned, the extent of solids-like behavior generally increases with the slurry solid volume fraction (SVF), which is given as $$SVF=\text{Particle volume}/(\text{Particle volume}+\text{Liquid volume})$$

It follows that proppant or other large particle mode settling in multimodal implementations may if desired be minimized independently of the viscosity of the continuous phase. Therefore, in some example implementations little or no viscosifier and/or yield stress agent, e.g., a gelling agent, is required to inhibit settling and achieve particle transport, such as, for example, less than 2.4 g/L, less than 1.2 g/L, less than 0.6 g/L, less than 0.3 g/L, less than 0.15 g/L, less than 0.08 g/L, less than 0.04 g/L, less than 0.2 g/L or less than 0.1 g/L of viscosifier may be present in the STS.

It is helpful for an understanding of the current application to consider the amounts of particles present in the slurries of various implementations of the treatment fluid. The minimum amount of fluid phase necessary to make a homogeneous slurry blend is the amount required to just fill all the void space in the PVF with the continuous phase, i.e., when SVF=PVF. However, this blend may not be flowable since all the solids and liquid may be locked in place with no room for slipping and mobility. In flowable system implementations, SVF may be lower than PVF, e.g., SVF/

PVF≤0.99. In this condition, in a stabilized treatment slurry, essentially all the voids are filled with excess liquid to increase the spacing between particles so that the particles may roll or flow past each other. In some example implementations, the higher the PVF, the lower the SVF/PVF ratio should be to obtain a flowable slurry.

Figure 2:
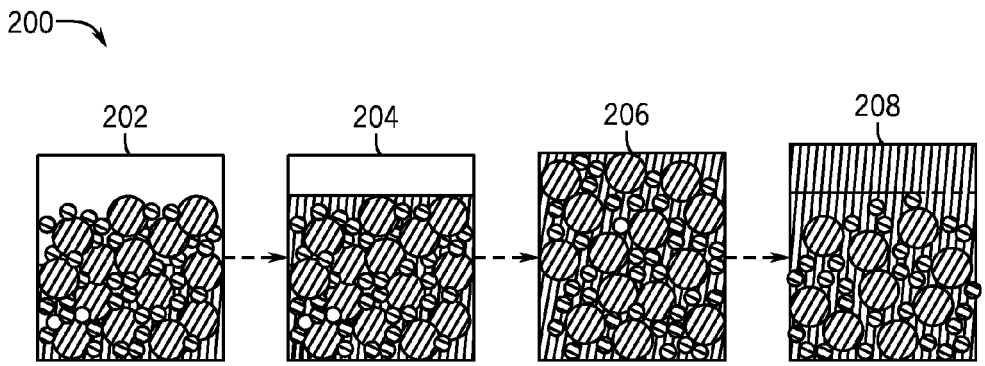
FIG. 2 is a slurry state progression chart according to an example implementation.

FIG. 2 shows a slurry state progression chart for a system 200 having a particle mix with added fluid phase. A first fluid 202 does not have enough liquid added to fill the pore spaces of the particles, or in other words the SVF/PVF is greater than 1.0, and the first fluid 202 is not flowable. A second fluid 204 has just enough fluid phase to fill the pore spaces of the particles, or in other words, the SVF/PVF is equal to 1.0. Testing determines whether the second fluid 204 is flowable and/or pumpable, but a fluid with an SVF/PVF of 1.0 is generally not flowable or barely flowable due to an excessive apparent viscosity and/or yield stress. A third fluid 206 has slightly more fluid phase than is required to fill the pore spaces of the particles, or in other words the SVF/PVF is just less than 1.0. A range of SVF/PVF values less than 1.0 will generally be flowable and/or pumpable or mixable, and if it does not contain too much fluid phase (and/or contains an added viscosifier) the third fluid 206 is stable. The values of the range of SVF/PVF values that are pumpable, flowable, mixable, and/or stable are dependent upon, without limitation, the specific particle mixture, fluid phase viscosity, the PVF of the particles, and the density of the particles. Simple laboratory testing of the sort ordinarily performed for fluids before fracturing treatments may readily determine the stability (e.g., the STS stability test as described herein) and flowability (e.g., apparent dynamic viscosity at 170 $s^{-1}$ and 25° C. of less than about 10,000 mPa-s).

A fourth fluid 208 that is depicted in FIG. 2 has more fluid phase than the third fluid 206, to the point where the fourth fluid 208 is flowable but is not stabilized and settles, forming a layer of free fluid phase at the top (or bottom, depending upon the densities of the particles in the fourth fluid 208). The amount of free fluid phase and the settling time over which the free fluid phase develops before the fluid is considered unstable are parameters that depend upon the specific circumstances of a treatment, as noted above. For example, if the settling time over which the free liquid develops is greater than a planned treatment time, then in one example the fluid would be considered stable. Other factors, without limitation, that may affect whether a particular fluid remains stable include the amount of time for settling and flow regimes (e.g. laminar, turbulent, Reynolds number ranges, etc.) of the fluid flowing in a flow passage of interest or in an agitated vessel, e.g., the amount of time and flow regimes of the fluid flowing in the wellbore, fracture, etc., and/or the amount of fluid leakoff occurring in the wellbore, fracture, etc. A fluid that is stable for one fracturing treatment may be unstable for a second fracturing treatment. The determination that a fluid is stable at particular conditions may be an iterative determination based upon initial estimates and subsequent modeling results. In some example implementations, the stabilized treatment fluid passes the STS test described herein.

Figure 3:
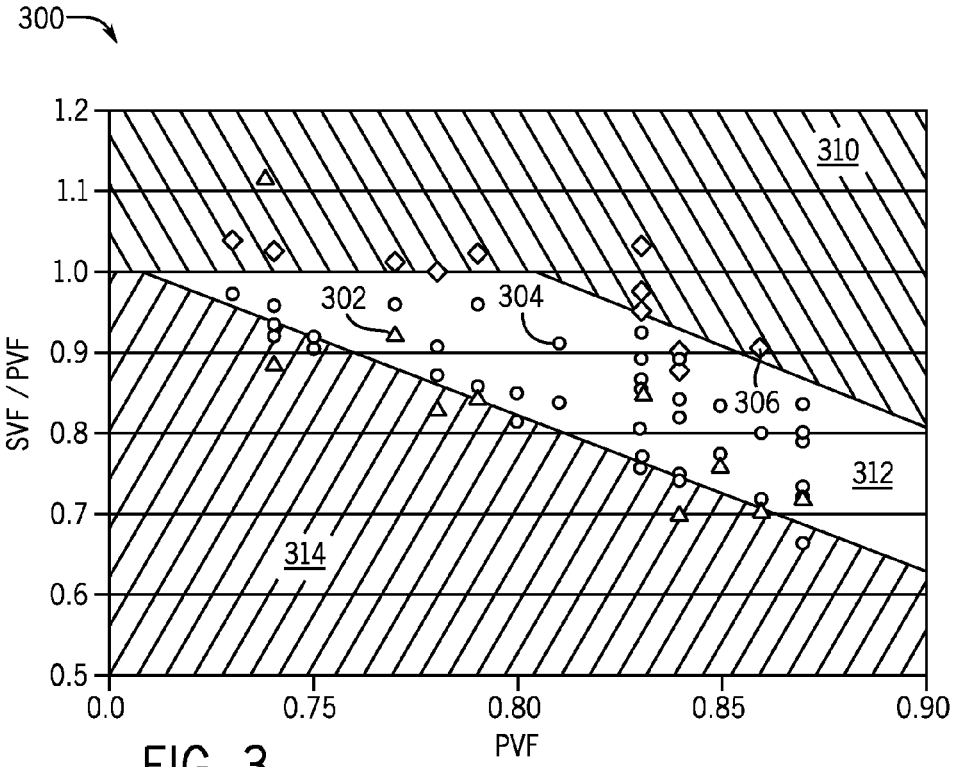
FIG. 3 illustrates a ratio of a slurry solids volume fraction to a packed volume fraction versus the packed volume fraction according to example implementations.
Figure 4:
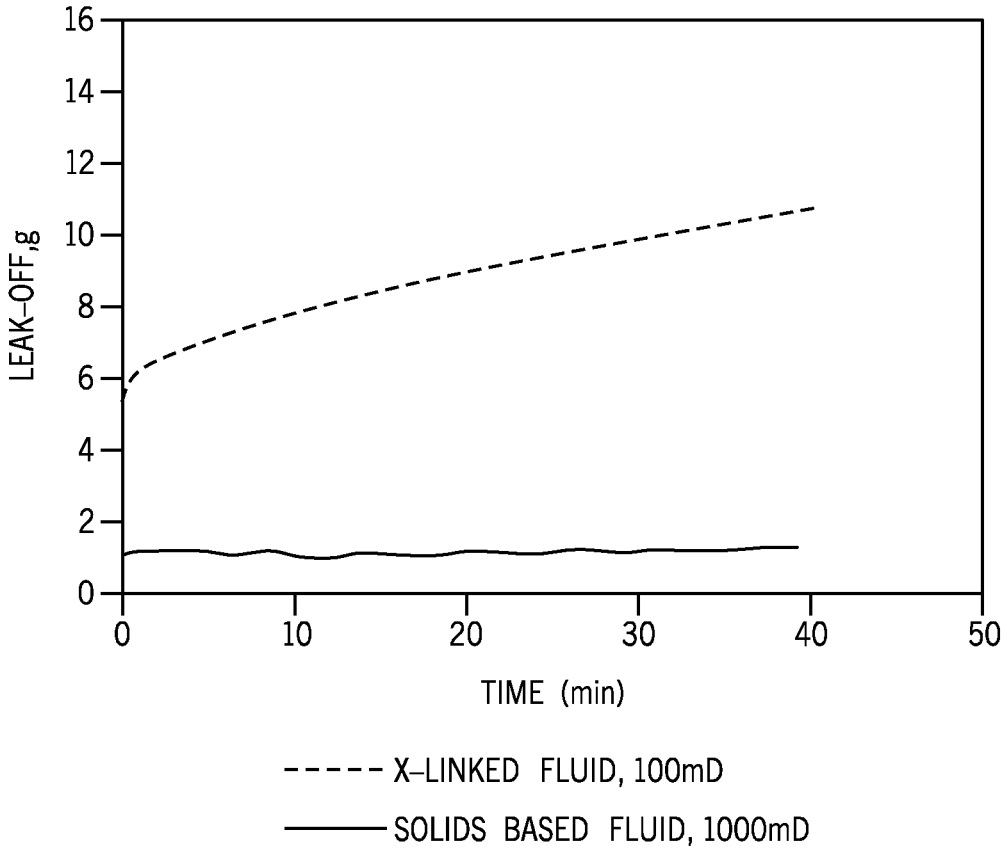
FIG. 4 is an illustration of a leak off versus time for different fluids according to example implementations.

FIG. 3 shows an example data set 300 of fluids (essentially Newtonian fluids) without any added viscosifiers and without any yield stress, which were tested for the progression of slurry state on a plot of SVF/PVF as a function of PVF. The fluid phase in the experiments was water and the solids had specific gravity 2.6 g/mL. Data points 302 indicated with triangles represent values for fluids that have free water in the slurry, data points 304 indicated with circles represent values for slurriable fluids that are mixable without excessive free water, and data points 306 indicated with diamonds represent values for fluids that are not easily mixable liquid-solid mixtures. The data set 300 includes fluids prepared having a number of discrete PVF values, with liquid added until the mixture transitions from not mixable to a slurriable fluid, and then further progresses to a fluid having excess settling. At an example for a solids mixture with a PVF value near PVF=0.83, around an SVF/PVF value of 0.95 the fluid transitions from an unmixable mixture to a slurriable fluid. At around an SVF/PVF of 0.7, the fluid transitions from a stable slurry to an unstable fluid having excessive settling. It can be seen from the data set 300 that the compositions may be defined approximately into a non-mixable region 310, a slurriable region 312, and a settling region 314.

FIG. 3 shows the useful range of SVF and PVF for slurries in example implementations without gelling agents. In some example implementations, the SVF is less than the PVF, or the ratio SVF/PVF is within the range from about 0.6 or about 0.65 to about 0.95 or about 0.98. Where the liquid phase has a viscosity less than 10 mPa-s or where the treatment fluid is water essentially free of thickeners, in some example implementations PVF is greater than 0.72 and a ratio of SVF/PVF is greater than about 1−2.1*(PVF−0.72) for stability (non-settling). Where the PVF is greater than 0.81, in some example implementations a ratio of SVF/PVF may be less than 1−2.1*(PVF−0.81) for mixability (flowability). Adding thickening or suspending agents, or solids that perform this function such as calcium carbonate or colloids, i.e., to increase viscosity and/or impart a yield stress, in some example implementations allows fluids otherwise in the settling area 314 implementations (where SVF/PVF is less than or equal to about 1−2.1*(PVF−0.72)) to also be useful as an STS or in applications where a non-settling, slurriable/mixable slurry is beneficial, e.g., where the treatment fluid has a viscosity greater than 10 mPa-s, greater than 25 mPa-s, greater than 50 mPa-s, greater than 75 mPa-s, greater than 100 mPa-s, greater than 150 mPa-s, or greater than 300 mPa-s; and/or a yield stress greater than 0.1 Pa, greater than 0.5 Pa, greater than 1 Pa, greater than 10 Pa or greater than 20 Pa.

Introducing high-aspect ratio particles into the treatment fluid, e.g., particles having an aspect ratio of at least 6, represents additional or alternative implementations for stabilizing the treatment fluid. Examples of such non-spherical particles include, but are not limited to, fibers, flakes, discs, rods, stars, etc., as described in, for example, U.S. Pat. No. 7,275,596 and U.S. Patent Application Publication No. US 2008/0196896, which are each hereby incorporated by reference in its entirety. In certain example implementations, introducing ciliated or coated proppant into the treatment fluid may stabilize or help stabilize the treatment fluid.

Proppant or other particles coated with a hydrophilic polymer may make the particles behave like larger particles and/or more tacky particles in an aqueous medium. The hydrophilic coating on a molecular scale may resemble ciliates, i.e., proppant particles to which hairlike projections have been attached to or formed on the surfaces thereof. Herein, hydrophilically coated proppant particles are referred to as "ciliated or coated proppant." Hydrophilically coated proppants and methods of producing them are described, for example, in PCT Application Publication No. WO 2011/050046, U.S. Pat. No. 5,905,468, U.S. Pat. No. 8,227,026 and U.S. Pat. No. 8,234,072, which are each hereby incorporated by reference in its entirety.

In some additional or alternative implementation, the STS system may have the benefit that the smaller particles in the voids of the larger particles act as slip additives like mini-ball bearings, allowing the particles to roll past each other without any requirement for relatively large spaces between particles. This property may be demonstrated In some example implementations by the flow of the STS through a relatively small slot orifice with respect to the maximum diameter of the largest particle mode of the STS, e.g., a slot orifice less than 6 times the largest particle diameter, without bridging at the slot, i.e., the slurry flowed out of the slot has an SVF that is at least 90% of the SVF of the STS supplied to the slot. In contrast, the slickwater technique requires a ratio of perforation diameter to proppant diameter of at least 6, and additional enlargement for added safety to avoid screen out usually dictates a ratio of at least 8 or 10 and does not allow high proppant loadings.

In example implementations, the flowability of the STS through narrow flow passages such as perforations and fractures is similarly facilitated, allowing a smaller ratio of perforation diameter and/or fracture height to proppant size that still provides transport of the proppant through the perforation and/or to the tip of the fracture, i.e., improved flowability of the proppant in the fracture, e.g., in relatively narrow fracture widths, and improved penetration of the proppant-filled fracture extending away from the wellbore into the formation. These implementations provide a relatively longer proppant-filled fracture prior to screenout relative to slickwater or high-viscosity fluid treatments.

As used herein, the "minimum slot flow test ratio" refers to a test wherein an approximately 100 mL slurry specimen is loaded into a fluid loss cell with a bottom slot opened to allow the test slurry to come out, with the fluid pushed by a piston using water or another hydraulic fluid supplied with an ISCO pump or equivalent at a rate of 20 mL/min, wherein a slot at the bottom of the cell may be adjusted to different openings at a ratio of slot width to largest particle mode diameter less than 6, and wherein the maximum slot flow test ratio is taken as the lowest ratio observed at which 50 vol % or more of the slurry specimen flows through the slot before bridging and a pressure increase to the maximum gauge pressure occurs. In some example implementations, the STS has a minimum slot flow test ratio less than 6, or less than 5, or less than 4, or less than 3, or a range of 2 to 6, or a range of 3 to 5.

Because of the relatively low water content (high SVF) of some implementations of the STS, fluid loss from the STS may be a concern where flowability is important and SVF should at least be held lower than PVF, or considerably lower than PVF in some other implementations. In conventional hydraulic fracturing treatments, there are two main reasons that a high volume of fluid and high amount of pumping energy have to be used, namely proppant transport and fluid loss. To carry the proppant to a distant location in a fracture, the treatment fluid has to be sufficiently turbulent (slickwater) or viscous (gelled fluid). Even so, only a low concentration of proppant is typically included in the treatment fluid to avoid settling and/or screen out. Moreover, when a fluid is pumped into a formation to initiate or propagate a fracture, the fluid pressure will be higher than the formation pressure, and the liquid in the treatment fluid is constantly leaking off into the formation. This is especially the case for slickwater operations. The fracture creation is a balance between the fluid loss and new volume created. As used herein, "fracture creation" encompasses either or both the initiation of fractures and the propagation or growth thereof. If the liquid injection rate is lower than the fluid loss rate, the fracture cannot be grown and becomes packed off. Therefore, traditional hydraulic fracturing operations are not efficient in creating fractures in the formation.

In some example implementations of the STS herein where the SVF is high, even a small loss of carrier fluid may result in a loss of flowability of the treatment fluid, and In some example implementations it is therefore undertaken to guard against excessive fluid loss from the treatment fluid, at least until the fluid and/or proppant reaches its ultimate destination. In example implementations, the STS may have an excellent tendency to retain fluid and thereby maintain flowability, i.e., it has a low leakoff rate into a porous or permeable surface with which it may be in contact. According to some implementations of the current application, the treatment fluid is formulated to have very good leakoff control characteristics, i.e., fluid retention to maintain flowability. The good leak control may be achieved by including a leakoff control system in the treatment fluid of the current application, which may comprise one or more of high viscosity, low viscosity, a fluid loss control agent, selective construction of a multi-modal particle system in a multimodal fluid (MMF) or in a stabilized multimodal fluid (SMMF), or the like, or any combination thereof.

As discussed in the examples below and as shown in FIG. 3, the leakoff of implementations of a treatment fluid of the current application was an order of magnitude less than that of a conventional crosslinked fluid. It should be noted that the leakoff characteristic of a treatment fluid is dependent on the permeability of the formation to be treated. Therefore, a treatment fluid that forms a low permeability filter cake with good leakoff characteristic for one formation may or may not be a treatment fluid with good leakoff for another formation. Conversely, certain example implementations of the treatment fluids of the current application form low permeability filter cakes that have substantially superior leakoff characteristics such that they are not dependent on the substrate permeability provided the substrate permeability is higher than a certain minimum, e.g., at least 1 mD.

In certain example implementations herein, the STS includes a packed volume fraction (PVF) greater than a slurry solids volume fraction (SVF), and has a spurt loss value (Vspurt) less than 10 vol % of a fluid phase of the stabilized treatment fluid or less than 50 vol % of an excess fluid phase (Vspurt<0.50*(PVF−SVF), where the "excess fluid phase" is taken as the amount of fluid in excess of the amount present at the condition SVF=PVF, i.e., excess fluid phase=PVF−SVF).

In some example implementations the treatment fluid includes an STS also having a relatively low leakoff rate. For example, the total leakoff coefficient may be about $3\times10^{-4}$ $m/min^{1/2}$ ($10^{-3}$ $ft/min^{1/2}$) or less, or about $3\times10^{-5}$ $m/min^{1/2}$ ($10^{-4}$ $ft/min^{1/2}$) or less. As used herein, Vspurt and the total leak-off coefficient Cw are determined by following the static fluid loss test and procedures set forth in Section 8-8.1, "Fluid loss under static conditions," in *Reservoir Stimulation,* 3rd Edition, Schlumberger, John Wiley & Sons, Ltd., pp. 8-23 to 8-24, 2000, in a filter-press cell using ceramic disks (FANN filter disks, part number 210538) saturated with 2% KCl solution and covered with filter paper and test conditions of ambient temperature (25° C.), a differential pressure of 3.45 MPa (500 psi), 100 ml sample loading, and a loss collection period of 60 minutes, or an equivalent testing procedure. In some example implementations of the current application, the treatment fluid has a fluid loss value of less than 10 g in 30 min when tested on a core sample with 1000 mD porosity. In some example implementations of the current application, the treatment fluid has a fluid loss value of less than 8 g in 30 min when tested on a core sample with 1000 mD porosity. In some example implementations of the current application, the treatment fluid has a fluid loss value of less than 6 g in 30 min when tested on a core sample with 1000 mD porosity. In some example implementations of the current application, the treatment fluid has a fluid loss value of less than 2 g in 30 min when tested on a core sample with 1000 mD porosity.

The unique low to no fluid loss property allows the treatment fluid to be pumped at a low rate or pumping stopped (static) with a low risk of screen out. In example implementations, the low fluid loss characteristic may be obtained by including a leak-off control agent, such as, for example, particulated loss control agents (In some example implementations less than 1 micron or 0.05-0.5 microns), graded PSD or multimodal particles, polymers, latex, fiber, etc. As used herein, the terms leak-off control agent, fluid loss control agent and similar refer to additives that inhibit fluid loss from the slurry into a permeable formation.

As representative leakoff control agents, which may be used alone or in a multimodal fluid, there may be mentioned latex dispersions, water soluble polymers, submicron particulates, particulates with an aspect ratio higher than 1, or higher than 6, combinations thereof and the like, such as, for example, crosslinked polyvinyl alcohol microgel. The fluid loss agent may be, for example, a latex dispersion of polyvinylidene chloride, polyvinyl acetate, polystyrene-co-butadiene; a water soluble polymer such as hydroxyethylcellulose (HEC), guar, copolymers of polyacrylamide and their derivatives; particulate fluid loss control agents in the size range of 30 nm to 1 micron, such as γ-alumina, colloidal silica, $CaCO_3$, $SiO_2$, bentonite etc.; particulates with different shapes such as glass fibers, flakes, films; and any combination thereof or the like. Fluid loss agents may if desired also include or be used in combination with acrylamido-methyl-propane sulfonate polymer (AMPS). In example implementations, the leak-off control agent comprises a reactive solid, e.g., a hydrolysable material such as PGA, PLA or the like; or it may include a soluble or solubilizable material such as a wax, an oil-soluble resin, or another material soluble in hydrocarbons, or calcium carbonate or another material soluble at low pH; and so on. In example implementations, the leak-off control agent comprises a reactive solid selected from ground quartz, oil soluble resin, degradable rock salt, clay, zeolite or the like. In other implementations, the leak-off control agent comprises one or more of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass, or the like.

The treatment fluid may additionally or alternatively include, without limitation, friction reducers, clay stabilizers, biocides, crosslinkers, breakers, corrosion inhibitors, and/or proppant flowback control additives. The treatment fluid may further include a product formed from degradation, hydrolysis, hydration, chemical reaction, or other process that occur during preparation or operation.

In certain example implementations herein, the STS may be prepared by combining the particles, such as proppant if present and subproppant, the carrier liquid and any additives to form a proppant-containing treatment fluid; and stabilizing the proppant-containing treatment fluid. The combination and stabilization may occur in any order or concurrently in single or multiple stages in a batch, semi-batch or continuous operation. For example, in some example implementations, the base fluid may be prepared from the subproppant particles, the carrier liquid and other additives, and then the base fluid combined with the proppant.

The treatment fluid may be prepared on location, e.g., at the wellsite when and as needed using conventional treatment fluid blending equipment.

Figure 5A:
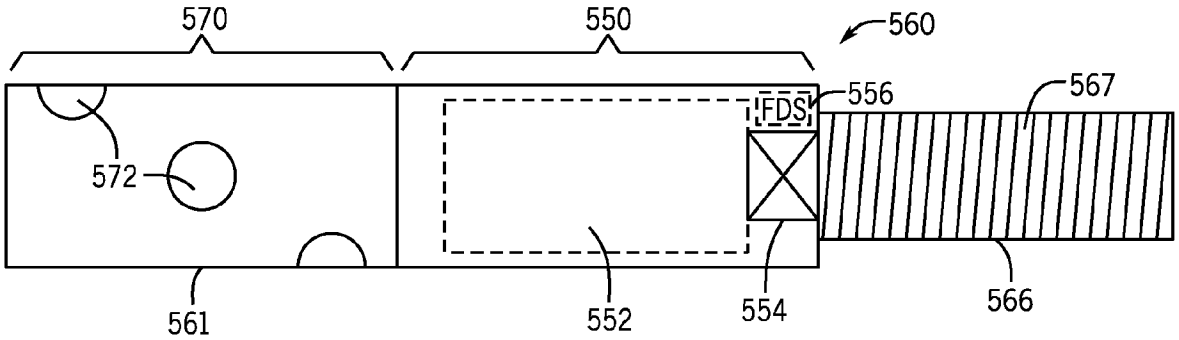
FIG. 5A is a schematic view of a downhole perforating and plug setting tool assembly according to an example implementation.

Referring to FIG. 5A, in accordance with example implementations, a plug, or fluid barrier, may be created by pumping a tool assembly 560 downhole with an STS layer and using the tool assembly 560 to controllably dehydrate the STS layer. In general, in accordance with example implementations, the tool assembly 560 includes a generally circular cylindrical housing 561, which has a diameter that is slightly less than an inner diameter of the string (a casing string, for example) into which the tool assembly 560 is pumped. The housing 561 includes an internal chamber 552, which is initially closed and contains a fluid (air, for example) that is at a pressure that is significantly lower than a pressure outside of the housing 561. As a more specific example, in accordance with some implementations, the chamber 552 may have an atmospheric pressure in a run-in-hole state of the tool assembly 560.

The tool assembly 560 also includes a screen 566, which extends from the housing 561, in accordance with example implementations, as shown in FIG. 5A. In general, screen 566 may have an outer diameter that is less than the outer diameter of the housing 561. The annular space about the screen 566 allows the formation of an STS-derived solid layer about the screen 566 to form the corresponding fluid barrier, or plug, as further described herein. As examples, the screen 566 may be a wire-wrapped screen or a slotted screen, depending on the particular implementation. The screen 566 may contain one or more fabric layers, in yet a further example implementation. Regardless of the particular construction of the screen 566, the screen 566 is designed to filter out particulates from the STS layer to allow a continuous liquid phase of the STS to enter an interior space 567 of the screen 566 when a fluid control device 554 of the tool assembly 560 is open.

More specifically, in accordance with example implementations, the fluid control device 554 controls fluid communication between the interior space 567 of the screen 566 and the chamber 552. In the run-in-hole state of the tool assembly 560, the flow control device 554 is closed, i.e., the device 554 isolates the interior chamber 552 from the interior space 567 of the screen 566. After the tool assembly 560 has been pumped downhole with the STS layer to the target location for the fluid barrier (as further disclosed herein), the tool assembly 560 opens the fluid control device 554 to establish fluid communication between the internal chamber 552 and the interior space 567 of the screen 566. This creates a lower pressure region to draw the continuous fluid phase from the portion of the STS layer that surrounds the screen 566 into the screen's interior space 567 and further into the chamber 552. The removal of the continuous fluid phase from the portion of the STS layer surrounding the screen, in turn, significantly increases a bulk velocity of this portion, resulting in the creation of a cement-like mixture about the screen 566 within (in accordance with example implementations) a relatively short time period (within twenty seconds, as an example). In accordance with example implementations, the opening of the flow device 554 creates the cement-like mixture about the screen 566, as well as stop any further movement of the tool assembly 560 in the wellbore.

The flow control device 554 may be a valve (a sleeve valve, a ball valve, and so forth) or may be membrane, in accordance with example implementations.

Among its other features, in accordance with some implementations, the tool assembly 560 is a multiple function tool that, in addition to having a section 550 that controls fluid communication through the screen 566 to form the plug, or fluid barrier, has a section 570 that contains a perforating gun. Thus, in accordance with example implementations, the portion 570 of the tool assembly 560 may contain elements of a perforating gun, such as shaped charges 572, a detonating cord (not shown), a firing head (not shown), and so forth.

In accordance with example implementations, for purposes of operating the flow control device 554, the tool assembly 560 contains a feature detection sensor (FDS) module 556, which may be contained in the portion 550. In accordance with example implementations, the FDS module 556 senses the downhole position of the tool assembly 560 as the tool assembly 560 is being pumped into the well and actuates the fluid control device 554 at the appropriate time based on the sensed position to form a fluid barrier at a target downhole location.

Figure 5B:
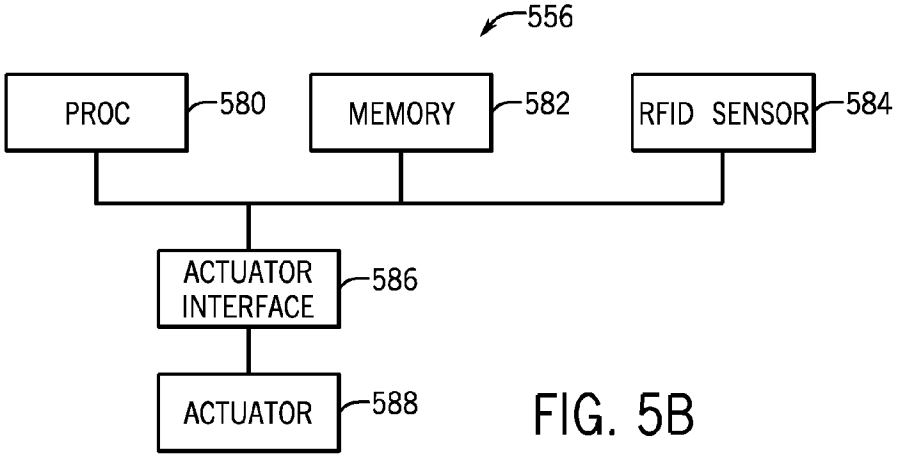
FIG. 5B is a schematic diagram of a feature detection system of the tool assembly of FIG. 5A according to an example implementation.

Referring to FIG. 5B in conjunction with FIG. 5A, in accordance with example implementations, the feature detection sensor module 556 may contain at least one sensor for purposes of sensing features of the well so that the module 556 may determine the tool's position and operate the fluid control device 554 to transition from its closed state to its open state at the appropriate time. For the specific example that is depicted in FIG. 5B, the FDS module 556 includes a radio frequency identification (RFID) sensor 584. For this example implementation, the RFID sensor 584 senses markers that are distributed along the well and contain RFIDs.

In this manner, in accordance with an example implementation, the RFIDs may transmit signals indicating identical identifications, so that by sensing and counting the RFIDs, the FDS module 556 may determine the location of the tool assembly 560. In further example implementations, the RFIDs indicated by the markers may be different, and the FDS module 556 may determine when the tool assembly 560 approaches the desired target location when the tool passes by a given RFID that is uphole from and associated with the target location.

Thus, regardless of the types of sensors and markers that are employed, in accordance with some implementations, the FDS module 556 may sense/determine the position of the tool assembly 560 and actuate the fluid control device 554. Other detection/sensing schemes may be used by the FDS module 556, other than those mentioned herein, as can be appreciated by the skilled artisan, in accordance with further implementations. An example may be running another tool into the well on a conveyance mechanism to mechanically shift or inductively communicate with the tool to be actuated.

Among its other features, the FDS module 556 may include a processor 580, which schematically represents one or more central processing units (CPUs), microcontrollers, field programmable gate arrays (FPGAs), and so forth. In general, the processor 580 may, for example, execute machine executable instructions, or program instructions, that are stored in a non-transitory memory 582 (a memory formed from semiconductor storage, magnetic storage, optical storage, a combination of these storage technologies, and so forth) to perform one or more of the sensing/detecting techniques that are disclosed herein. Upon analyzing the sensed data provided by the sensor 584, the processor 580 may determine an appropriate time to open the flow control device 554 to stop the progress of the tool assembly 560 and form the corresponding fluid barrier about the screen 566. For this purposes, the processor 580 may, through an actuator interface 586 of the FDS module 556, operate a valve actuator 588 (an electrical motor-based actuator, for example) that, in turn, operates a flow control element to control fluid communication through the valve 554.

Many other variations are contemplated and are within the scope of the appended claims. For example, in accordance with further example implementations, the tool assembly 560 may contain an expandable deployment mechanism, which may be actuated by a processor for purposes of halting the throughhole progress of the tool assembly 560. In this regard, in accordance with example implementations, the tool assembly 560 may contain a mechanism for halting the progress of the tool assembly 560 and a separate mechanism for actuating the flow control device 554 for purposes of forming the fluid barrier. As another example, in accordance with further implementations, the tool assembly may not contain a perforating gun.

Figure 6A:
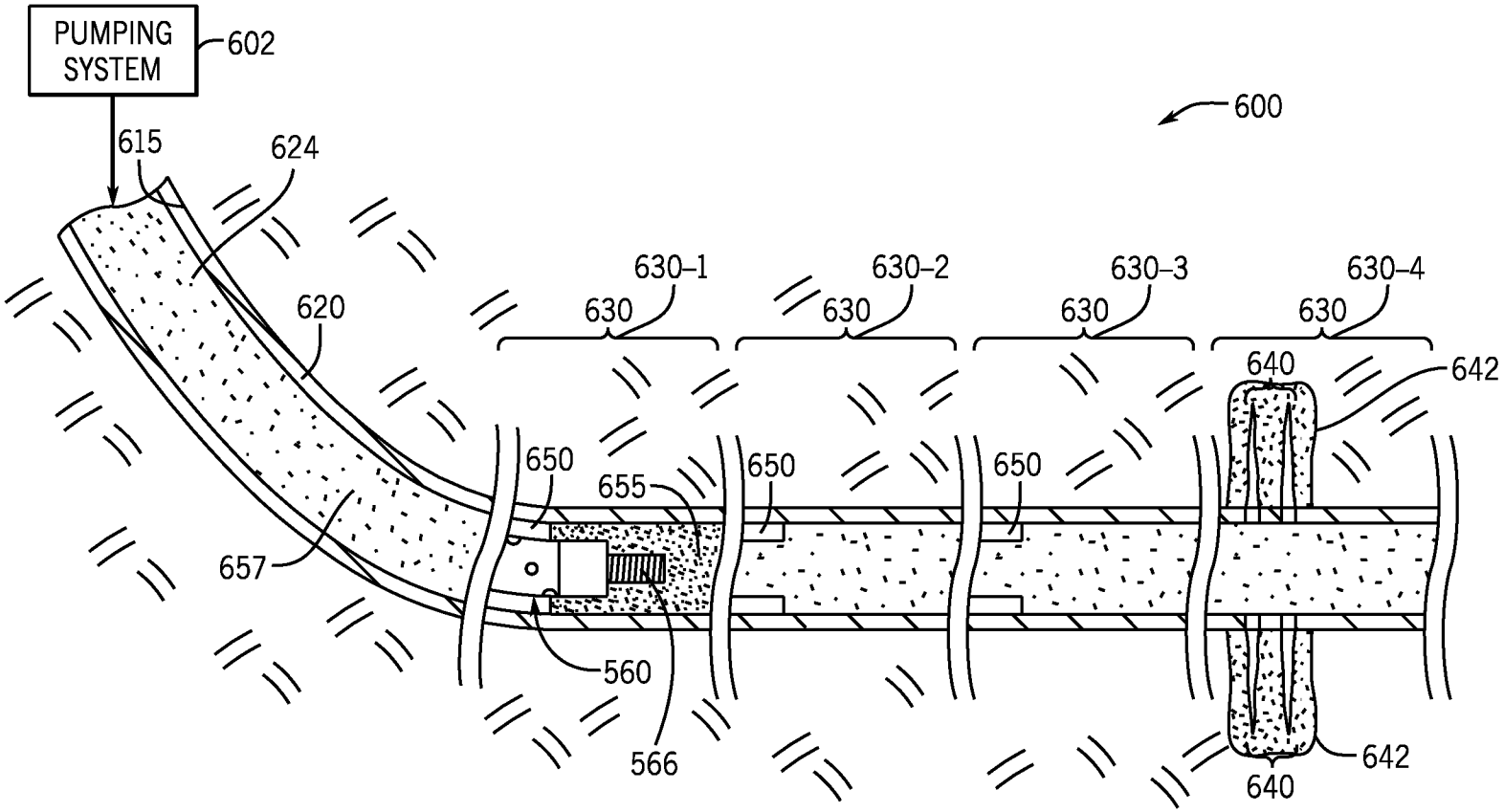
FIGS. 6A, 6B, 6C and 6D are schematic diagrams of wells illustrating a sequence of multiple stage stimulation operations according to an example implementation.

Referring to FIG. 6A, as a more specific example, the tool assembly 560 may be used in a well 600 for purposes of completing a given zone, or stage 630 (example stages 630-1, 630-2, 630-3 and 630-4, being depicted in FIG. 6A as examples), of the well 600. For the example of FIG. 6A, the stages 630 are stimulated from the toe end of a wellbore 615 to a heel end of the wellbore 615. In general, the wellbore 615 extends through the stages 630, and, as depicted in FIG. 6A, may be lined, or supported by, a casing string 620. The wellbore 615 may be uncased in an arrangement called an "open hole completion," in accordance with further implementations.

For the example of FIG. 6A, the stage 630-4 has already been stimulated (fractured, for example), as indicated by perforation tunnels 640 extending through the casing string 620 into the surrounding formation and a corresponding fracture zone 642 being formed about the perforation tunnels 640. The tool assembly 560 for the example of FIG. 6A is being pumped into a central passageway 624 of the wellbore 615 from the Earth surface for purposes of ultimately arriving in the stage 630-3, where a stimulation operation is to be performed.

More specifically, in accordance with example implementations, an Earth surface-based pumping system 602 delivers and pumps fluids into the well, including an STS layer 655. The tool assembly 560 is deployed into the central passageway 624 uphole, or behind, the STS layer 655 for purposes of serving as a piston to push the STS layer 655 to the desired downhole location. As depicted in FIG. 6A, the screen 566 of the tool assembly 560 extends into the STS layer 655. Another fluid 657 may be pumped behind the tool assembly 560, as illustrated in FIG. 6A.

Figure 6B:
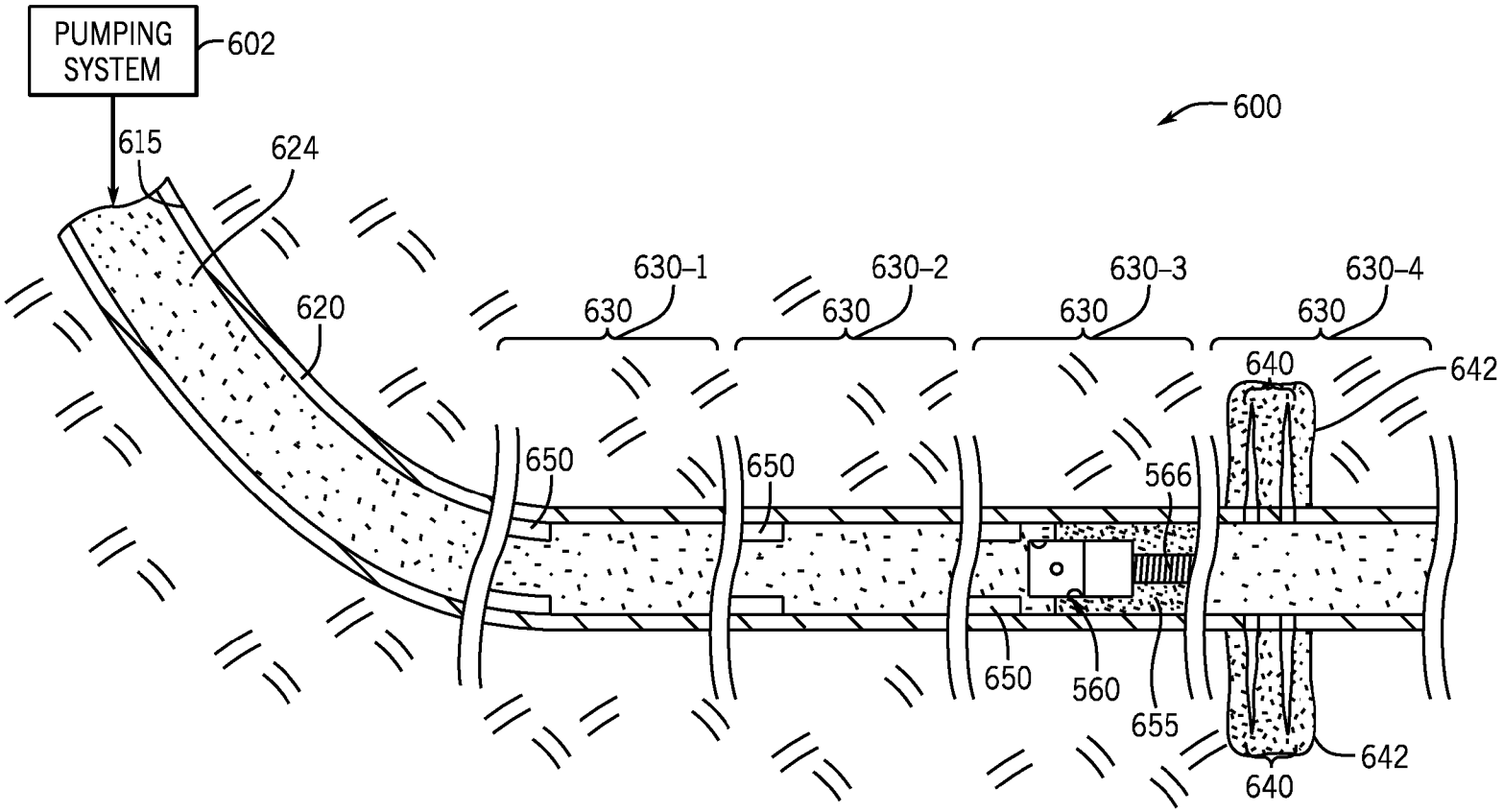

FIG. 6B depicts a state of the well 600 in which the tool assembly 560 is within the stage 630-3 and at or near the target location for the plug to be formed. As an example, the FDS module 556 (see FIG. 5A) of the tool assembly 560 at this point has detected the position of the tool assembly 560 as being in the stage 630-3 and, in accordance with example implementations, has opened fluid communication through the flow control device 554 (see FIG. 5A) to establish fluid communication with the lower pressure internal chamber 552 of the tool assembly 560. Due to the inrush of the continuous fluid phase of the STS layer 655 into the screen 566, downhole progress of the tool assembly 560 is halted. As mentioned above, in accordance with further implementations, upon sensing that the tool assembly 560 is at the appropriate location or uphole and near the target location, the FDS module 556 may actuate another mechanism to halt the progress of the tool assembly 560.

Regardless of the particular technique used to halt the tool assembly 560, the progress of the tool assembly 560 is halted at or near the position that is depicted in FIG. 6B. In accordance with example implementations, the perforating gun of the tool assembly 560 may fire its perforating charges to form corresponding perforation tunnels 640 that extend through the casing string wall and into the surrounding formation. For example, in accordance with some implementations, a processor of the tool assembly 560 may actuate a firing head of the perforating gun. Alternatively, in accordance with some implementations, the firing head may respond to a firing command stimulus (a wireline stimulus, an acoustic wave stimulus, an electromagnetic (EM) wave stimulus, and so forth) that is communicated from the Earth surface.

Figure 6C:
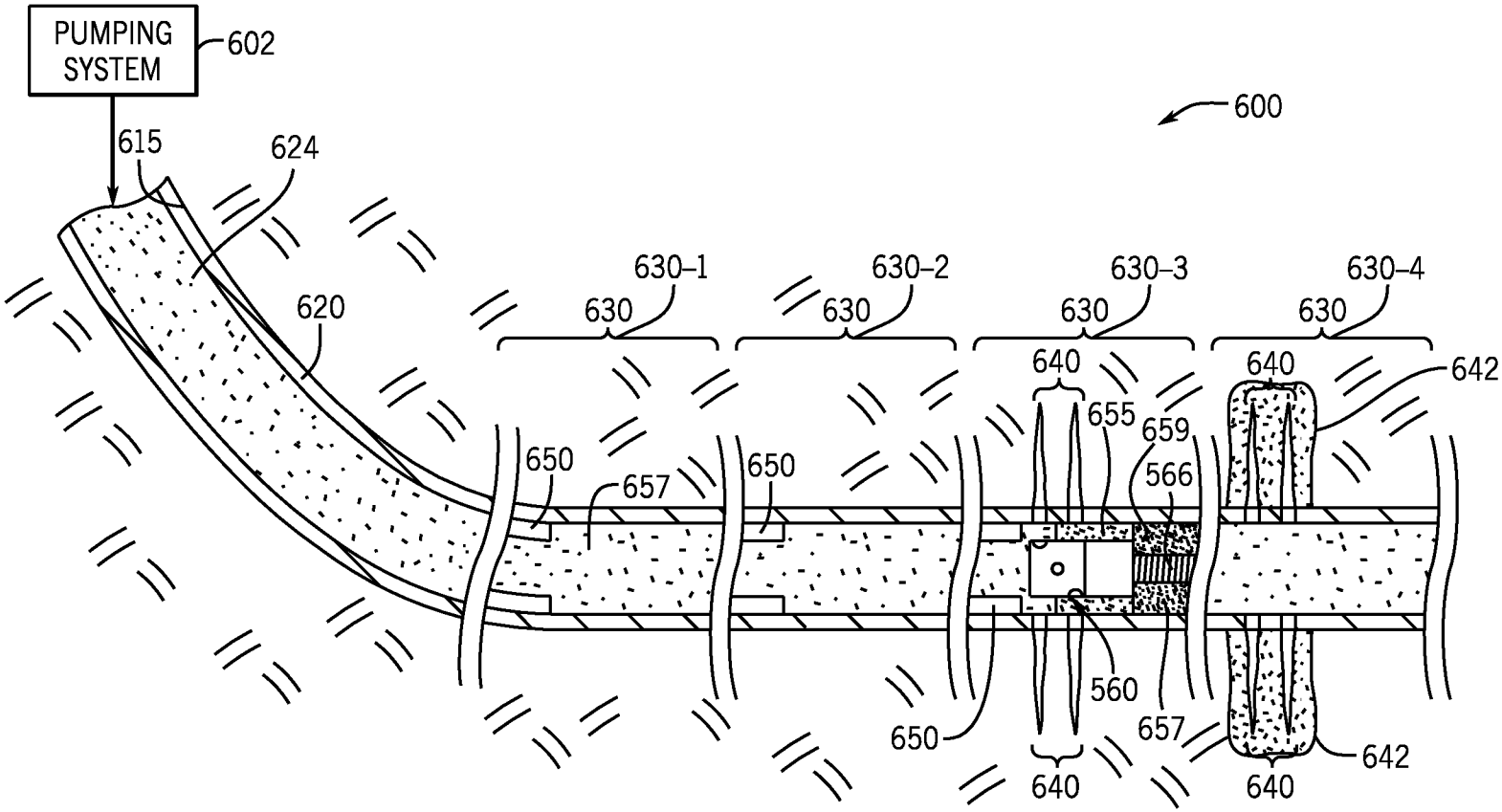
Figure 6D:
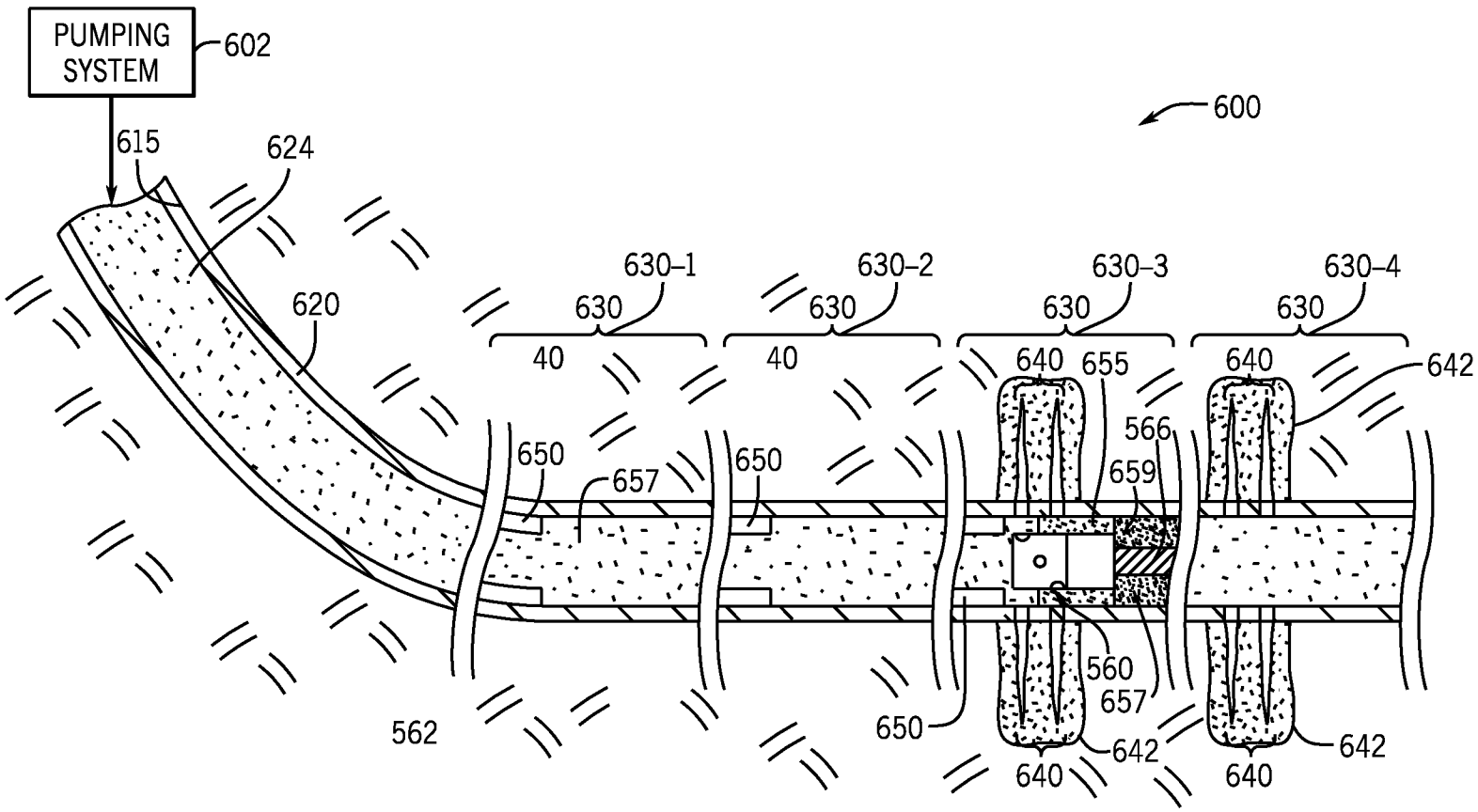

Depending upon the particular implementation, before, concurrent with or after the firing of the perforating charges, the FDS module 556 opens fluid communication through the flow control device 554 to form a relatively high viscosity fluid barrier 659 about the screen 566, as depicted in FIG. 6C. Referring to FIG. 6D, the fluid barrier 659 may then be used to isolate a lower boundary of the stage 630-3 so that a fracturing fluid may be communicated into the stage 630-3 to form a corresponding fracture zone 642 in the stage 630-3, as depicted in FIG. 6D.

In accordance with example implementations, after the fracture zone 642 is created, the tool assembly 560 may be removed from the well using any of a number of techniques, such as fishing the tool assembly 560 from the well and milling to remove the tool assembly 560. For purposes of aiding the removal of the tool assembly 560 from the well for fishing or otherwise retrieval of the tool assembly 560, the STS may include a degradable material. In this manner, the degradable material, over a sufficient time (a time that spans several days or more, for example) allows the dehydrated mixture to become sufficiently brittle so that the mixture may break off and allow fishing or retrieval of the tool assembly 560 from the well.

More specifically, in accordance with example implementations, the STS may be a multimodal mixture having different particulate sizes, and the STS includes a degradable material that is associated with at least one of the smaller particulate sizes (i.e. the second, third, fourth, and/or fifth size particulates). Examples of degradable materials include, without limitation, wax, oil-soluble resin, materials soluble in hydrocarbons, lactide, glycolide, aliphatic polyester, poly (lactide), poly(glycolide), poly(.epsilon.-caprolactone), poly (orthoester), poly(hydroxybutyrate), aliphatic polycarbonate, poly(phosphazene), poly(anhydride), poly(saccharide), dextran, cellulose, chitin, chitosan, protein, poly(amino acid), polyethylene oxide), and copolymers including polylactic acids) and/or poly(glycolic acids), and the like. In some example implementations, degradable materials may include a copolymer including a first moiety that is a hydroxyl group, a carboxylic acid group, and/or a hydrocarboxylic acid group, and a second moiety that is a glycolic acid and/or a lactic acid.

According to some example implementations, at least one of the smaller particulate sizes of the STS may include a reactive solid that reacts with a hydrolysis product of a degradable material. For example, the STS may include a degradable material and a reactive solid that reacts with the hydrolysis product of the degradable material to enhance the rate of degradation. As examples, the reactive solid may include ground quartz, oil soluble resin, degradable rock salt, clay, and/or zeolite or the like. In certain embodiments, the reactive solid includes magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and/or sodium calcium magnesium polyphosphate glass or the like. The degradable materials and reactive solids that enhance degradation may be stored on the same particle, such that reactions do not occur at the surface but begin within the fluids at downhole conditions. Other details about the inclusion of degradable materials in the STS may be found, for example, in U.S. Patent Application Publication No. US 2012/0138296.

In accordance with some implementations, the tool assembly 560 may be constructed from one or more materials that degrade or oxidize in the well environment. For example, the housing of the perforating gun, the housing of the dehydration tool and so forth, may be formed from a degradable material. In this manner, over a short time (a day or a few days, for example) in which the tool assembly 560 is run downhole and operated and used to form the fluid barrier, the degradable/oxidizable material(s) of the assembly 560 retain their structural integrity. However, over a longer time (a week or a month, as an example), the degradable/oxidizable material(s) sufficiently degrade in the presence of the wellbore fluids (or introduced fluids) to cause a partial or total collapse of the fluid barrier, thereby re-establishing fluid communication through the central passageway of the string. In accordance with example implementations, dissolvable, or degradable, alloys may be used similar to the alloys that are disclosed in the following patents: U.S. Pat. No. 7,775,279, entitled, "DEBRIS-FREE PERFORATING APPARATUS AND TECHNIQUE," which issued on Aug. 17, 2010; and U.S. Pat. No. 8,211,247, entitled, "DEGRADABLE COMPOSITIONS, APPARATUS COMPOSITIONS COMPRISING SAME, AND METHOD OF USE," which issued on Jul. 3, 2012.

Figure 7:
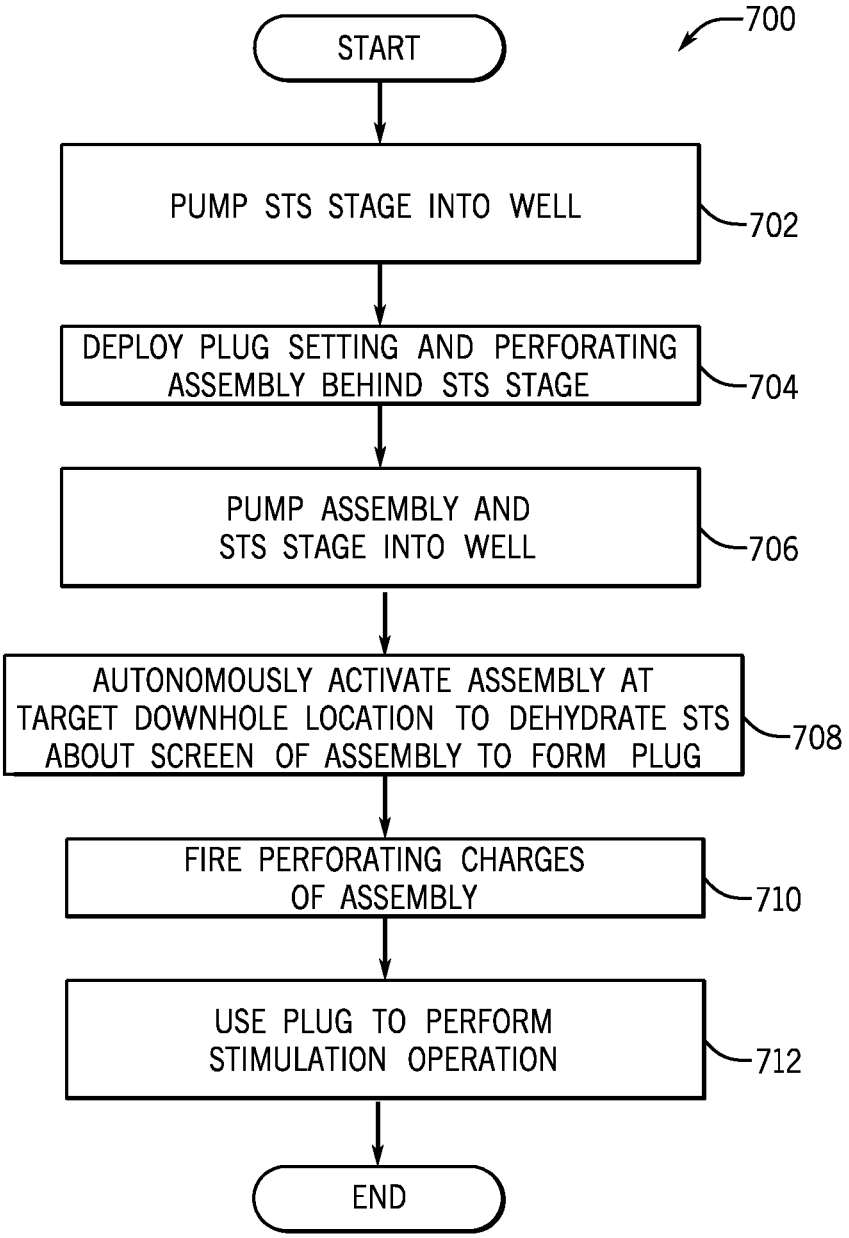
FIG. 7 is a flow diagram depicting a technique to stimulate a stage of a well according to an example implementation.

Referring to FIG. 7, in accordance with example implementations, a technique 700 includes pumping (block 702) an STS stage into a well and deploying (block 704) a plug setting and perforating assembly behind the STS stage. The technique 700 includes pumping the assembly and the STS stage into the well, pursuant to block 706 and autonomously activating (block 708) the assembly at a desired downhole location to dehydrate a portion of the STS stage about the screen of the assembly to form a plug. The technique 700 also includes firing (block 710) perforating charges of the assembly and using (block 712) the plug to perform a stimulation operation.

The techniques that are described herein may be used as part of an overall operation involving the staging of fracturing treatments. The technique begins with a wellbore that has been perforated and is isolated due to a plug that is disposed at a lower end to create an associated perforated zone. The zone is fractured by injecting a fracturing fluid above the fracturing pressure of the associated surrounding formation(s). The fracturing fluid may be, as examples, an STS or any other fracturing fluid, depending on the particular implementation. At the conclusion of the fracturing, an STS is deployed downhole, followed by the deployment of an assembly (such as tool assembly 560 discussed above, as an example), which contains a dehydration tool and a perforating gun. A wellbore plug may be then created at the upper end of the zone by dehydrating the STS with the dehydration tool. In accordance with an example implementation, the perforating gun may be then disconnected from the formed plug. For example, as discussed above, the STS may contain degradable materials allowing the perforation gun to break off from the formed plug. The perforating gun may then be moved to a region that corresponds to the next zone to be fractured, where the recently-formed STS-based plug forms the lower end barrier for the zone. The perforating charges (shaped charges, for example) of the perforating gun may then be fired to form perforations in the zone. Next, the above-described steps may be repeated to fracture the zone. The above-described process may be repeated to fracture additional zones of the well.

In accordance with some example implementations, the above-described assembly containing the dehydration tool and perforating gun may contain stacked sub-assemblies that are deployed on a string, where each sub-assembly contains a perforating gun and dehydration tool. In this manner, the above-described multiple stage fracturing operation may be performed in a single trip into the well such that, as each sub-assembly is used to form an associated plug, the remaining part of a string separates from the sub-assembly, thereby allowing the use of the next sub-assembly to form the next plug in the well. In accordance with further implementations, multiple trips may be performed such that in each trip, an assembly containing a dehydration tool and perforating gun is deployed in the well. Thus, many implementations are contemplated, which are within the scope of the appended claims.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method usable with a well, comprising:

communicating a slurry layer downhole into a stage of the well, the communicating comprising using a tool to engage the slurry layer and pumping the tool and the slurry layer together downhole into the well, wherein the tool comprises a screen and a closed chamber that has a lower pressure than a region outside of the chamber; and opening the chamber to cause a continuous fluid phase of the slurry layer to separate from the slurry layer and flow through the screen into the chamber to create a plug in the stage.

2. The method of claim 1 wherein:

the slurry layer is pushed from behind by the tool downhole into a passageway of the well; and the plug is formed in front of the tool in the passageway by dehydrating a portion of the slurry in the slurry layer.

3. The method of claim 2, wherein dehydrating the portion of the slurry comprises removing a continuous fluid phase of the slurry to increase a viscosity of the portion of the slurry.

4. The method of claim 2, wherein opening the chamber comprises:

communicating a signal downhole from an Earth surface of the well to the tool to cause the tool to open the chamber in response to the signal.

5. The method of claim 2, wherein opening the chamber comprises:

opening the chamber in response to the tool autonomously sensing a position of the tool.

6. The method of claim 5, wherein autonomously sensing the position of the tool comprises using the tool to autonomously sense features of the well and determine the position of the tool based at least in part on the sensed features.

7. The method of claim 6, wherein determining the position of the tool comprises determining the position based on a recognized sequence of the sensed features or determining the position based on recognition of one the features as being associated with a target downhole location for the plug.

8. The method of claim 2, further comprising:

using the plug as a boundary of the stage; and performing a stimulation operation in the stage.

9. The method of claim 2, wherein the slurry comprises a trimodal mixture of three particles.

10. The method of claim 2, wherein the passageway comprises a casing string.

11. The method of claim 1, further comprising:

deploying a perforating gun with the tool into the well;

firing at least one perforating charge of the perforating gun to perforate a formation associated with the stage.

12. The method of claim 1, further comprising:

waiting for at least a predetermined time interval for the plug to form after the chamber is opened; and after the waiting, performing a stimulation operation in the stage.

13. The method of claim 1, further comprising removing the tool from the well, the removing comprising an act selected from the group consisting essentially of:

fishing the tool from the well;

milling to remove the tool;

degrading the tool; and oxidizing the tool.

14. The method of claim 1, further comprising:

in at least one other stage of the well, communicating another slurry layer downhole into the at least one other stage and opening a chamber of another tool to receive a fluid to create a plug in the other stage.

15. The method of claim 1, wherein the slurry layer comprises a trimodal mixture of three particles.

* * * * *